US009235152B2

(12) United States Patent
Suzuki et al.

(10) Patent No.: US 9,235,152 B2
(45) Date of Patent: Jan. 12, 2016

(54) TONER AND METHOD FOR PRODUCING THE SAME

(71) Applicants: Kumiko Suzuki, Gifu (JP); Jun Ikami, Nagoya (JP)

(72) Inventors: Kumiko Suzuki, Gifu (JP); Jun Ikami, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/835,684

(22) Filed: Mar. 15, 2013

(65) Prior Publication Data

US 2013/0260304 A1 Oct. 3, 2013

(30) Foreign Application Priority Data

Mar. 30, 2012 (JP) ..... 2012-079661

(51) Int. Cl.
*G03G 9/087* (2006.01)
*G03G 9/097* (2006.01)
*G03G 9/08* (2006.01)

(52) U.S. Cl.
CPC ..... *G03G 9/08755* (2013.01); *G03G 9/081* (2013.01); *G03G 9/0804* (2013.01); *G03G 9/0821* (2013.01); *G03G 9/0823* (2013.01); *G03G 9/0825* (2013.01); *G03G 9/08782* (2013.01); *G03G 9/08797* (2013.01)

(58) Field of Classification Search
CPC ..... G03G 9/08755; G03G 9/09733; G03G 9/0804; G03G 9/0821
USPC ..... 430/108.4, 109.4, 111.4, 137.14
See application file for complete search history.

(56) References Cited

U.S. PATENT DOCUMENTS

| | | | | |
|---|---|---|---|---|
| 4,840,863 | A | 6/1989 | Otsu et al. | |
| 5,853,939 | A * | 12/1998 | Yanagibori et al. | 430/108.1 |
| 7,067,225 | B2 * | 6/2006 | Watanabe et al. | 430/123.51 |
| 7,514,190 | B2 * | 4/2009 | Ohmura et al. | 430/111.4 |
| 2008/0182198 | A1 | 7/2008 | Kawamura et al. | |
| 2008/0261137 | A1 | 10/2008 | Qin et al. | |
| 2008/0286674 | A1 | 11/2008 | Kawamura et al. | |
| 2009/0246681 | A1 | 10/2009 | Kawamura et al. | |
| 2011/0065036 | A1 * | 3/2011 | Inoue et al. | 430/108.2 |
| 2011/0086302 | A1 | 4/2011 | Zhou et al. | |

FOREIGN PATENT DOCUMENTS

| | | | | |
|---|---|---|---|---|
| CN | 101034266 | A | 9/2007 | |
| EP | 864930 | A1 * | 9/1998 | G03G 9/087 |
| JP | 63-060458 | A | 3/1988 | |
| JP | 03-175456 | A | 7/1991 | |
| JP | 03-243954 | A | 10/1991 | |
| JP | 11-015192 | A | 1/1999 | |
| JP | 2001330984 | A * | 11/2001 | G03G 9/08 |
| JP | 2005215257 | A * | 8/2005 | G03G 9/08 |
| JP | 2008-286944 | A | 11/2008 | |
| JP | 2010122425 | A * | 6/2010 | |
| JP | 2012018249 | A * | 1/2012 | |
| WO | 2012029611 | A1 | 3/2012 | |
| WO | 2012033221 | A1 | 3/2012 | |

OTHER PUBLICATIONS

English language machine translation of JP 2012-018249 (Jan. 2012).*
English language machine translation of JP 2001-330984 (Nov. 2001).*
English language machine translation of JP 2005-215257 (Aug. 2005).*
English language machine translation of JP 2010-1224425 (Jun. 2010).*
Extended Search Report issued in corresponding European Patent Application No. 13160003.3 dated May 24, 2013.
Jan. 7, 2015—(CN) Office Action—App 201310102208—Eng Tran.
May 7, 2015—(EP)—Office Action—App 13160003.3.

* cited by examiner

*Primary Examiner* — Christopher Rodee
(74) *Attorney, Agent, or Firm* — Banner & Witcoff, Ltd.

(57) ABSTRACT

There is provided a toner, including toner mother particles which contain a binder resin, a colorant, and a wax, wherein a difference between a density of the wax in a solid state and a density of the wax in a liquid state is not less than 0.11 g/cm$^3$; the density of the wax in the liquid state is not more than 0.835 g/cm$^3$; and a heat quantity of the wax per unit mass which is obtained from an endothermic peak area at a low temperature side measured by a differential scanning calorimetry is not less than 190 mJ/mg.

16 Claims, 1 Drawing Sheet

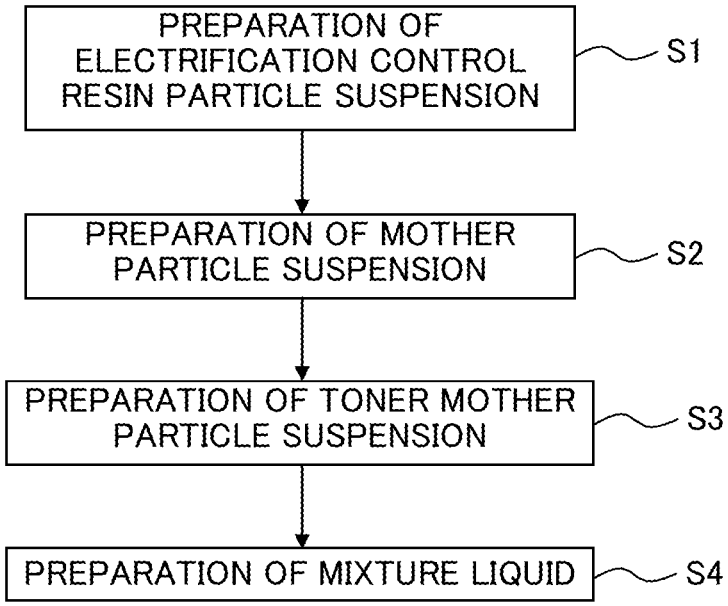
PREPARATION OF ELECTRIFICATION CONTROL RESIN PARTICLE SUSPENSION
S1
PREPARATION OF MOTHER PARTICLE SUSPENSION
S2
PREPARATION OF TONER MOTHER PARTICLE SUSPENSION
S3
PREPARATION OF MIXTURE LIQUID
S4

TONER AND METHOD FOR PRODUCING THE SAME

CROSS REFERENCE TO RELATED APPLICATION

The present application claims priority from Japanese Patent Application No. 2012-079661 filed on Mar. 30, 2012, the disclosure of which is incorporated herein by reference in its entirety.

BACKGROUND OF THE INVENTION

1. Field of the Invention

The present invention relates to a toner, which is used in an electrophotographic method and/or an electrostatic recording method, and a method for producing the toner.

2. Description of the Related Art

As a toner which is used in an electrophotographic method and/or an electrostatic recording method, there has been known a toner which contains a wax to ensure releasing performance with respect to a fixing member which fixes the toner to a recording medium (fixing objective) such as a paper sheet by application of heat and pressure.

As a method for producing the toner containing the wax as described above, there has been suggested, for example, a method for producing the toner in which a charge control agent is fixed to toner mother particles including a polyester resin containing an ester-based wax (for example, Japanese patent laid open No. 2008-286944, U.S. Patent Application Publication No. 2008/286674).

In the toner obtained by the producing method as described above, the ester-based wax is contained in the polyester resin.

Hence, speed-up of printing causes the following problem in some cases. That is, in a case that the toner is fixed to the recording medium, the toner can not be heated sufficiently and the releasing performance with respect to the fixing member is decreased.

In a case that the releasing performance is decreased, the toner is adhered to the fixing member in some cases, which decreases fixing performance of the toner with respect to the recording medium.

In view of this, an object of the present teaching is to provide a toner which is capable of improving releasing performance with respect to a fixing member and fixing performance with respect to a recording medium at low temperature and a method for producing the toner.

SUMMARY OF THE INVENTION

According to the first aspect of the present teaching, there is provided a toner, including toner mother particles which contain a binder resin, a colorant, and a wax, wherein a difference between a density of the wax in a solid state and a density of the wax in a liquid state is not less than 0.11 g/cm$^3$; the density of the wax in the liquid state is not more than 0.835 g/cm$^3$; and a heat quantity of the wax per unit mass which is obtained from an endothermic peak area at a low temperature side measured by a differential scanning calorimetry is not less than 190 mJ/mg.

According to the second aspect of the present teaching, there is provided a method for producing a toner, including: preparing an electrification control resin particle suspension in which electrification control resin particles are dispersed, by removing a first organic solvent from a first emulsion obtained such that an electrification control resin, the first organic solvent, and a first water base medium are blended to be emulsified; preparing a mother particle suspension in which mother particles containing a binder resin, a colorant, and a wax are dispersed, by removing a second organic solvent from a second emulsion obtained such that the binder resin, the colorant, the wax, the second organic solvent, and a second water base medium are blended to be emulsified; preparing a toner mother particle suspension in which toner mother particles are dispersed, by heating the mother particle suspension to fuse and aggregate the mother particles to form the toner mother particles; and mixing the electrification control resin particle suspension and the toner mother particle suspension, wherein a difference between a density of the wax in a solid state and a density of the wax in a liquid state is not less than 0.11 g/cm$^3$; the density of the wax in the liquid state is not more than 0.835 g/cm$^3$; a heat quantity of the wax per unit mass which is obtained from an endothermic peak area at a low temperature side measured by a differential scanning calorimetry is not less than 190 mJ/mg; and an anion equivalent of the toner mother particles is not more than $1\times10^{-5}$ mol/g and is more than 0 mol/g.

According to the third aspect of the present teaching, there is provided a method for producing a toner, including: preparing an electrification control resin particle suspension in which electrification control resin particles are dispersed, by removing a first organic solvent from a first emulsion obtained such that an electrification control resin, the first organic solvent, and a first water base medium are blended to be emulsified; preparing a mother particle suspension in which mother particles containing a binder resin, a colorant, and a wax are dispersed, by removing a second organic solvent from a second emulsion obtained such that the binder resin, the colorant, the wax, the second organic solvent, and a second water base medium are blended to be emulsified; preparing a toner mother particle suspension in which toner mother particles are dispersed, by heating the mother particle suspension to fuse and aggregate the mother particles to form the toner mother particles; and mixing the electrification control resin particle suspension and the toner mother particle suspension, wherein a difference between a density of the wax in a solid state and a density of the wax in a liquid state is not less than 0.11 g/cm$^3$; the density of the wax in the liquid state is not more than 0.835 g/cm$^3$; a heat quantity of the wax per unit mass which is obtained from an endothermic peak area at a low temperature side measured by a differential scanning calorimetry is not less than 190 mJ/mg; and a difference calculated by subtracting the anion equivalent from the cation equivalent of the toner mother particles is $-1.1\times10^{-5}$ to $1\times10^{-6}$ mol/g.

BRIEF DESCRIPTION OF THE DRAWINGS

The FIGURE is a flowchart showing a method for producing a toner according to the present teaching.

DESCRIPTION OF THE PREFERRED EMBODIMENTS

A method for producing a toner of the present teaching will be described below with reference to the FIGURE.

1. First Preparation Process (Synthesis of Electrification Control Resin Fine Particles)

In a method for producing a toner according to the present teaching, an electrification control resin fine particle suspension (an electrification control resin particle suspension) in which electrification control resin fine particles (electrification control resin particles) are dispersed is prepared by, at first, removing a first organic solvent from a first emulsion obtained such that an electrification control resin, the first organic solvent, and a first water base medium or aqueous medium are blended to be emulsified (first preparation process, step S1).

(1) Electrification Control Resin

The electrification control resin is exemplified, for example, by a synthetic resin having cationic group. The electrification control resin is blended in order to stably impart positive electrification or charge to the toner. In a case that the electrification control resin is the synthetic resin, the electrification control resin can be fixed to toner mother particles (as will be described later on) satisfactorily or successfully.

The cationic group is exemplified, for example, by quaternary ammonium group, quaternary ammonium salt-containing group, amino group, and phosphonium salt-containing group. Preferably, the cationic group is exemplified by the quaternary ammonium salt-containing group. If the cationic group is the quaternary ammonium salt-containing group, the electrification control resin can be emulsified stably and it is possible to improve stability of electrification or charge of the toner obtained.

The synthetic resin is exemplified, for example, by acrylic resin, acryl-styrene resin, polystyrene resin, and polyester resin. Preferably, the synthetic resin is exemplified by the acrylic resin and the acryl-styrene resin. More preferably, the synthetic resin is exemplified by the acryl-styrene resin. In a case that the synthetic resin is the acryl-styrene resin and that a binder resin of the toner mother particles (as will be described later on) is the polyester resin, since the acryl-styrene resin is hardly compatibly dissolved with the binder resin, it is possible to suppress that the electrification control resin is compatibly dissolved with the toner mother particles. Thus, it is possible to provide stable electrification performance (charging performance) to the toner. The synthetic resins as described above can be used alone (only one kind) or in combination of two or more of them.

The electrification control resin can be obtained by copolymerizing polymerizable monomer with the cationic group (cationic group-containing vinyl monomer) and polymerizable monomer which is capable of copolymerizing with the polymerizable monomer with the cationic group (copolymerizable vinyl monomer). For example, the acrylic resin and the acryl-styrene resin can be obtained by radical-copolymerizing (meta) acylate with the cationic group and (meta) acylate which is capable of copolymerizing with the (meta) acylate with the cationic group or styrene.

In a case that the electrification control resin is radical-copolymerized, the electrification control resin can be bridged or cross-linked by copolymerizing multifunctional polymerizable monomer such as multifunctional (di, tri, tetra) acylate and divinylbenzene as the copolymerizable vinyl monomer, as needed.

In a case that the electrification control resin is radical-copolymerized, the content of the cationic group in the electrification control resin can be adjusted arbitrarily by selecting the content of the cationic group-containing vinyl monomer appropriately.

In this case, the content of the cationic group-containing vinyl monomer is, for example, 4% by mass to 50% by mass, and is preferably 4% by mass to 40% by mass with respect to the total amount of all of the polymerizable monomers.

Mole ratio of the cationic group-containing vinyl monomer to all of the polymerizable monomers is, for example, 0.8 molar % to 40 molar %, and is preferably 0.8 molar % to 30 molar %.

The electrification control resin containing quaternary ammonium salt-containing group can be produced in accordance with descriptions of Japanese patent laid open No. 63-60458 (U.S. Pat. No. 4,840,863), Japanese patent laid open No. 03-175456, Japanese patent laid open No. 03-243954, Japanese patent laid open No. 11-15192, and the like. The electrification control resin containing the quaternary ammonium salt-containing group is exemplified, for example, by "FCA-201PS" (product name) produced by Fujikura Kasei Co., Ltd. (copolymer of styrene, butyl acrylate, and N,N-diethyl-N-methyl-2-(methacryloyloxy) ethylammonium=p-toluenesulfonate, (N,N-diethyl-N-methyl-2-(methacryloyloxy)ethylammonium=p-toluenesulfonate content: 14% by mass), weight average molecular weight (Mw): 15000, glass transition temperature (Tg): 66° C.), by "FCA-207P" (product name) produced by the same company (copolymer composed of 83% by mass of styrene, 15% by mass of butyl acrylate, and 2% by mass of N,N-diethyl-N-methyl-2-(methacryloyloxy) ethylammonium=P-toluenesulfonic acid, weight average molecular weight (Mw): 12,000, glass transition temperature (Tg): 67° C.), by "FCA-161P" (product name) produced by the same company, and by "FCA-78P" (product name) produced by the same company.

The weight average molecular weight (Mw) of the electrification control resin is preferably set within a range of 3,000 to 100,000. In a case that the weight average molecular weight (Mw) is lower than 3,000, the strength of the toner is decreased and the toner particles are aggregated or coagulated with each other in some cases. In a case that the weight average molecular weight (Mw) exceeds 100,000, the toner is too much hardened and the fixing performance thereof is decreased in some cases. The weight average molecular weight (Mw) is obtained by a GPC measurement (the measurement is performed by a method described in Examples as will be described later on) as a corresponding value of standard polystyrene.

The glass transition temperature (Tg) of the electrification control resin (the measurement is performed by a method described in Examples as will be described later on) is set to be 40° C. to 100° C. in view of the storage stability and the thermal fixing performance of the toner.

(2) First Organic Solvent

Although the first organic solvent is not specifically limited provided that the electrification control resin can be dissolved or swelled, the first organic solvent preferably has a certain level of water solubility to promote dissociation of the cationic group of the electrification control resin when the first organic solvent is emulsified in the first water base medium.

The organic solvent is exemplified, for example, by methyl ethyl ketone (MEK), ethyl acetate, tetrahydrofuran (THF), and acetone. The organic solvents as described above can be used alone (only one kind) or in combination of two or more of them.

(3) First Water Base Medium

The first water base medium is exemplified by water or a water base medium which is mainly composed of water and contains some amount of water-soluble solvent (for example, alcohols and glycols) or an additive (for example, a surfactant and a dispersing agent) as needed. According to the following emulsifying method, it is preferable that only the water is used as the first water base medium.

(4) Preparation of the First Emulsion

In order to prepare the first emulsion, for example, it is prepared an electrification control resin liquid in which the electrification control resin is dissolved or swelled by the first organic solvent, and then the electrification control resin liquid is emulsified in the first water base medium.

In order to prepare the electrification control resin liquid, for example, the electrification control resin is blended at a blending ratio of 5 to 100 parts by mass, preferably 10 to 50 parts by mass with respect to 100 parts by mass of the first organic solvent.

A method for blending the electrification control resin with the first organic solvent is not specifically limited. For example, the electrification control resin is blended with the first organic solvent, followed by being stirred (agitated) and mixed with each other so that the electrification control resin is dissolved or swelled.

Accordingly, the electrification control resin liquid in which the electrification control resin is dissolved or swelled by the first organic solvent is prepared.

Then, in order that the electrification control resin liquid is emulsified in the first water base medium, the electrification control resin liquid is blended at a blending ratio of, for example, 50 to 150 parts by mass and preferably 80 to 110 parts by mass with respect to 100 parts by mass of the first water base medium.

Thereafter, in a case that the first water base medium in which the electrification control resin liquid is blended has a volume of, for example, 1 to 3 liters, the first water base medium is stirred, for example, at a number of revolutions of 5000 to 20000 rpm (tip peripheral speed: 4 to 17 m/s), preferably 7000 to 16000 rpm (tip peripheral speed: 7 to 14 m/s), for example, for 5 to 60 minutes, preferably 10 to 30 minutes by using a publicly known dispersing machine such as a homogenizer or the like.

Accordingly, the electrification control resin liquid is emulsified in the first water base medium in a form of liquid droplets, and the first emulsion is prepared.

The first emulsion can be also prepared as follows. That is, at first, the first water base medium and the first organic solvent are blended, and then the electrification control resin is blended with the obtained mixture liquid of the first water base medium and the first organic solvent, followed by being stirred as in the same manner as described above.

In this case, in order to obtain the mixture liquid of the first water base medium and the first organic solvent, the first organic solvent is blended at a blending ratio of, for example, 4 to 140 parts by mass and preferably 60 to 90 parts by mass with respect to 100 parts by mass of the first water base medium.

Further, in a case that the electrification control resin is blended with the mixture liquid of the first water base medium and the first organic solvent, the electrification control resin is blended at a blending ratio of, for example, 2 to 50 parts by mass and preferably 5 to 25 parts by mass with respect to 100 parts by mass of the mixture liquid.

In the preparation of the first emulsion as described above, the electrification control resin can be emulsified by using the cationic group in the electrification control resin instead of blending an emulsion stabilizer (for example, the surfactant, the dispersing agent, and a neutralizing agent). Accordingly, it is possible to reduce the emulsion stabilizer contained in the obtained toner, and thus it is possible to stabilize the electrification performance of the toner.

(5) Preparation of Electrification Control Resin Fine Particle Suspension

In order to obtain the electrification control resin fine particle suspension, the first organic solvent is removed from the first emulsion.

In the preparation method, since the electrification control resin contains the cationic group, the electrification control resin, which is dissolved or swelled in the first organic solvent in the preparation of the first emulsion, is stably emulsified in the first water base medium. Since the electrification control resin fine particle suspension can be obtained by removing the first organic solvent from the first emulsion, the electrification control resin fine particle suspension is prepared as an electrification control resin fine particle suspension having a low aggregation.

In order to remove the first organic solvent from the first emulsion, any known method is used, which includes, for example, the blowing, the heating, the pressure reduction, and any combination thereof. In particular, in order to remove the first organic solvent from the first emulsion, the first emulsion is heated at a temperature of, for example, ordinary (normal) temperature to 90° C. and preferably 50 to 80° C., for example, in an inert gas atmosphere of nitrogen or the like, until about 80 to 95% by mass of the first organic solvent in an initial amount is removed.

Accordingly, the first organic solvent is removed from the first emulsion, and it is prepared the electrification control resin fine particle suspension (slurry) in which the electrification control resin fine particles are dispersed in the first water base medium. Solid content concentration (concentration of the electrification control resin fine particles in the electrification control resin fine particle suspension) is, for example, 5 to 55% by mass, and preferably 15 to 45% by mass.

The volume average particle diameter of the fine particles of the electrification control resin is, for example, 50 to 800 nm, preferably 100 to 550 nm as the median diameter.

The volume average particle diameter of the fine particles of the electrification control resin can be set within the range as described above by appropriately controlling the viscosity obtained when the electrification control resin is blended with the first organic solvent, the blending ratio of the electrification control resin liquid with water, stirring velocity of a high-speed dispersing machine at the time of preparing the first emulsion, and the like.

The amount of the cationic group (cation equivalent) existing on the surfaces of the electrification control resin fine particles is, for example, $4.5\times10^{-6}$ to $8.0\times10^{-5}$ mol/g, preferably $5.0\times10^{-6}$ to $5.0\times10^{-5}$ mol/g.

In a case that the amount of the cationic group is smaller than the range as described above, electrification of the toner is insufficient and thereby image formation failure is caused in some cases. In a case that the amount of the cationic group is larger than the range as described above, excessive electrostatic attractive force is acted between the electrification control resin fine particles and toner mother particles (as will be described later) in a mixing process (as will be described later) and the yield of the toner in the present teaching (yield of the toner particles) is decreased in some cases. By making the amount of the cationic group within the range as described above, it is possible to provide an appropriate electrification performance to the toner, and it is possible to produce the toner of the present teaching efficiently.

The amount of the cationic group can be measured, for example, by a colloid titration method (flow potential method).

2. Second Preparation Process

In the method for producing the toner according to the present teaching, a mother fine particle suspension (a mother particle suspension) in which mother fine particles (mother particles) containing a binder resin, a colorant, and a wax are dispersed, is independently prepared by removing a second organic solvent from a second emulsion obtained such that the binder resin, the colorant, the wax, the second organic solvent, and a second water base medium are blended to be emulsified (second preparation process, step S2).

(1) Binder Resin

The toner is mainly composed of the binder resin. The binder resin is exemplified, for example, by the polyester resin which has functional group having an acid value (for example, carboxyl group). The binder resin is fixed (thermally fused) on a surface of the recording medium (a paper sheet, an OHP sheet, etc.) by heating and/or applying pressure thereto.

The polyester resin having the acid value is exemplified by a polyester resin as follows: the acid value is, for example, 0.5 to 40 mgKOH/g and preferably 1.0 to 20 mgKOH/g, the weight average molecular weight (based on the GPC measurement by using standard polystyrene for a calibration curve) is, for example, 9,000 to 200,000 and preferably 20,000 to 150,000, the gel part (THF insoluble part) is, for example, not more than 10% by mass and preferably 0.5 to 10% by mass, and the glass transition temperature (Tg) is, for example, 50 to 70° C. and preferably 55 to 65° C. In particular, a commercially available polyester resin is exemplified, for example, by FC1565 (Tg: 62° C., Mn (number average molecular weight): 3600, Mw (weight average molecular weight): 50000, gel content: less than 2 wt %, acid value: 6.0 KOH mg/g, produced by Mitsubishi Rayon Co. Ltd.), FC1588 (Tg: 52° C., Mn (number average molecular weight): 2000, Mw (weight average molecular weight): 4800, gel content: 0 wt %, acid value: 4.1 KOH mg/g, produced by Mitsubishi Rayon Co. Ltd.), ER508 (Tg: 63° C., Mn (number average molecular weight): 3700, Mw (weight average molecular weight): 113000, gel content: less than 2 wt %, acid value: 8.0 KOH mg/g, produced by Mitsubishi Rayon Co. Ltd.), and FC023.

In a case that the acid value is lower than the range as described above, since an amount of the binder resin to be reacted with base to be added later such as sodium hydroxide is low, emulsification becomes unstable and stable slurry can not be obtained in some cases. On the other hand, in a case that the acid value is higher than the range as described above, the positive electrification of the toner is deteriorated and image density is decreased in some cases.

In a case that the weight average molecular weight is lower than the range as described above, mechanical strength of the toner is insufficient and durability of the toner is decreased in some cases. On the other hand, in a case that the weight average molecular weight is higher than the range as described above, coarse particles are more likely to be generated, because melt viscosity of the toner increases excessively and emulsified liquid droplets become large.

It is not indispensable to contain the gel part. However, the gel part is preferably included to some extent in view of strength and/or fixing performance of the toner (in particular, offset at a high temperature side). Noted that, in a case that the gel part is larger than the range as described above, the emulsified liquid droplets become large and the coarse particles are more likely to be generated in some cases.

(2) Colorant

The colorant provides a desired color to the toner, and is dispersed or permeated in the polyester resin.

Those usable as the colorant include, for example, carbon black; organic pigments such as Quinophthalone Yellow, Hansa Yellow, Isoindolinone Yellow, Benzidine Yellow, Penoline Orange, Perinone Red, Perylene Maroon, Rhodamine 6G Lake, Quinacridone Red, Rose Bengal, Copper Phthalocyanine Blue, Copper Phthalocyanine Green, diketopyrrolopyrrole-based pigments and the like; inorganic pigments or metal powders such as Titanium White, Titanium Yellow, Ultramarine, Cobalt Blue, Indian Red (colcothar), aluminum powder, bronze and the like; oil-soluble dyes or disperse dyes such as azo dyes, quinophthalone dyes, anthraquinone dyes, xanthene dyes, triphenylmethane dyes, phthalocyanine dyes, indophenol dyes, indoaniline dyes and the like; and rosin dyes such as rosin, rosin-modified phenol, rosin-modified maleic acid resin, and the like. Further, there are also exemplified dyes and pigments processed, for example, with higher fatty acid or resin.

The colorants as described above can be used alone (only one kind) or in combination of two or more of them depending on the desired color. For example, the toner of a chromatic single color can be blended with the pigment and the dye based on the same color, for example, the pigment and the dye based on Rhodamine, the pigment and the dye based on Quinophthalone, and the pigment and the dye based on Phthalocyanine respectively.

The colorant is blended, for example, at a ratio of 2 to 20 parts by mass and preferably 4 to 10 parts by mass with respect to 100 parts by mass of the binder resin.

(3) Wax

The wax is added to improve the fixing performance of the toner with respect to the recording medium.

The wax is exemplified, for example, by an ester-based wax and a hydrocarbon-based wax.

The ester-based wax includes, for example, aliphatic ester compounds such as stearic acid ester (stearic acid stearyl, stearic acid behenyl, and the like), heneicosanoic acid ester (heneicosanoic acid behenyl and the like), myristic acid ester (myristic acid behenyl and the like), and palmitic acid ester; and polyfunctional ester compounds such as pentaerythritol tetramyristate, pentaerythritol tetrapalmitate, dipentaerythritol hexamyristate, and dipentaerythritol hexapalmitate. Out of these, the stearic acid behenyl or the heneicosanoic acid behenyl is preferable as the wax. Further, the difference between density of each wax in a solid state and density of each wax melted to be a liquid state is large. Therefore, high thermal energy is generated at the time of fixing the toner, thereby enhancing the fixing performance of the toner with respect to the recording medium at low temperature.

The hydrocarbon-based wax includes, for example, polyolefin waxes such as low molecular weight polyethylene, low molecular weight polypropylene, low molecular weight polybutylene and the like; plant-based natural waxes such as candelilla, carnauba, rice, Japan tallow or Japan wax, jojoba and the like; petroleum-based waxes and modified waxes thereof such as paraffin-based wax, microcrystalline, petrolatum and the like; and synthetic waxes such as Fischer-Tropsch wax and the like.

These waxes can be used alone (only one kind) or in combination of two or more of them.

The difference between the density of the wax in the solid state and the density of the wax melted to be the liquid state is, for example, not less than 0.11 g/cm$^3$ and, for example, not more than 0.15 g/cm$^3$. Especially, the difference in the density as described above is preferably not less than 0.133 g/cm$^3$ and not more than 0.145 g/cm$^3$.

The density of the wax melted to be the liquid state is, for example, not more than 0.835 g/cm$^3$ and, for example, not less than 0.8 g/cm$^3$.

In a case that the difference between the density of the wax in the solid state and the density of the wax melted to be the liquid state is within the range as described above, releasing performance can be improved and fixing performance at low temperature can be improved.

Heat quantity of the wax per unit mass, which is obtained from an endothermic peak area (as will be described later on)

at a low temperature side measured by differential scanning calorimetry (measurement is performed under a measurement condition described in Examples as will be described later), is, for example, not less than 190 mJ/mg.

In a case that the heat quantity of the wax per unit mass obtained from the endothermic peak area (as will be described later on) at the low temperature side is within the range as described above, the fixing performance at the low temperature is improved.

It is preferable that the difference between the density of the wax in the solid state and the density of the wax melted to be the liquid state is not less than 0.11 g/cm$^3$ (hereinbelow, referred to as "characteristic (I)" as appropriate); that the density of the wax melted to be the liquid state is not more than 0.835 g/cm$^3$ (hereinbelow, referred to as "characteristic (II)" as appropriate); and that the heat quantity of the wax per unit mass, which is obtained from the endothermic peak area at the low temperature side measured by the differential scanning calorimetry is not less than 190 mJ/mg (hereinbelow, referred to as "characteristic (III)" as appropriate). In the wax having the characteristics (I) to (III), the high thermal energy is generated at the time of fixing the toner. Therefore, it is possible to enhance the fixing performance of the toner with respect to the recording medium at the low temperature. Since the fixing performance of the toner with respect to the recording medium is improved, the releasing performance of the toner with respect to the fixing member is also improved.

Of the waxes as described above, a wax having a melt point of 50 to 100° C. is preferably used. Even when a heating temperature of a fixing unit is low, the wax having the low melt point and the low melt viscosity is melted before the binder resin is melted to be leaked out on the surface of the toner. Accordingly, the offset can be avoided.

Of the waxes as described above, the ester-based wax is preferably used.

The ester-based wax can be, for example, synthesized by the condensation reaction of fatty acid and alcohol.

The fatty acid includes, for example, saturated or unsaturated fatty acid which has alkyl group having a number of carbon atoms of 10 to 25, such as lauric acid, myristic acid, pentadecylic acid, palmitic acid, margaric acid, stearic acid, tuberculostearic acid, arachic acid, heneicosanoic acid, and behenic acid.

The alcohol includes, for example, monohydric alcohol which has alkyl group having a number of carbon atoms of 3 to 25 such as lauryl alcohol, myristyl alcohol, cetyl alcohol, stearyl alcohol, and behenyl alcohol; and polyhydric alcohols such as pentaerythritol and dipentaerythritol.

The condensation reaction of fatty acid and alcohol is caused as follows. That is, the fatty acid and the alcohol are introduced into a flask to which, for example, a thermometer, a stirring blade, a cooling tube, and a nitrogen inlet tube are attached, and then reaction water is volatilized and removed by reacting the fatty acid with the alcohol for 15 to 30 hours at 200 to 250° C. while feeding nitrogen to the gaseous phase to obtain a crude product.

In order to remove unreacted material, the organic solvent such as toluene and basic aqueous solution is added to the obtained crude product to remove a water layer.

The obtained oil layer is washed with water until the water layer is neutralized, and then is heated and stirred under reduced pressure to remove the organic solvent so that the obtained oil layer is condensed. Accordingly, the ester-based wax is prepared.

It is prepared the ester-based wax including, for example, stearic acid stearyl (ester condensate of stearic acid with stearyl alcohol), stearic acid behenyl (ester condensate of stearic acid with behenyl alcohol), heneicosanoic acid behenyl (ester condensate of heneicosanoic acid with behenyl alcohol), myristic acid behenyl (ester condensate of myristic acid with behenyl alcohol), and dipentaerythritol hexamyristate (ester condensate of myristic acid with dipentaerythritol).

Each of the waxes is blended, for example, at a ratio of 1 to 20 parts by mass and preferably 3 to 10 parts by mass with respect to 100 parts by mass of the binder resin.

(4) Second Emulsion (4-1) Preparation of Binder Resin Liquid

In order to prepare the second emulsion, at first, the binder resin, the colorant, and the wax are mixed with the second organic solvent to prepare the binder resin liquid. The second organic solvent is exemplified, for example, by the organic solvent which is the same as that in the first preparation process (first organic solvent).

In order to prepare the binder resin liquid, at first, with respect to 100 parts by mass of the second organic solvent, the binder resin is blended at a blending ratio of, for example, 5 to 40 parts by mass and preferably 10 to 30 parts by mass; the colorant is blended at a blending ratio of, for example, 0.25 to 3 parts by mass and preferably 0.5 to 2 parts by mass; and the wax is blended at a blending ratio of, for example, 0.25 to 4 parts by mass and preferably 0.5 to 3 parts by mass, followed by being mixed.

Thereafter, the obtained mixture (the mixture of the binder resin, the colorant, the wax, and the second organic solvent) is heated at a temperature, which is not less than a temperature at which the wax is soluble and is less than the boiling point of the second organic solvent. Specifically, depending on the types of the wax and the second organic solvent, the temperature is a temperature which exceeds, for example, 30° C. and the temperature is preferably 32 to 79° C. so that the wax is dissolved in the second organic solvent.

The binder resin liquid can be prepared also as follows. That is, a colorant dispersion is prepared by dispersing the colorant in the second organic solvent in advance; and then, the colorant dispersion is blended with the second organic solvent, the binder resin and wax. In this case, it is possible to add the dispersing agent or the binder resin instead of the dispersing agent in order to disperse the colorant. The binder resin is preferably added.

In order to prepare the colorant dispersion, with respect to 100 parts by mass of the colorant, the binder resin is blended at a blending ratio of, for example, 50 to 200 parts by mass and preferably 80 to 150 parts by mass and the second organic solvent is blended at a blending ratio of, for example, 100 to 3600 parts by mass and preferably 400 to 3500 parts by mass, followed by performing preliminary dispersion by means of a stirrer or agitator (for example, disper or homogenizer) and then performing fine dispersion by means of a dispersing machine (for example, a bead mill, a high-pressure homogenizer).

(4-2) Second Water Base Medium

The second water base medium in the second preparation process is exemplified, for example, by the water base medium which is the same as that in the first preparation process (first water base medium) and an alkaline aqueous solution.

The alkaline aqueous solution is exemplified, for example, by an organic base aqueous solution obtained by dissolving a basic organic compound such as an amine compound or the like in water and/or an inorganic base aqueous solution obtained by dissolving hydroxide of alkali metal such as potassium hydroxide or the like in water or an aqueous solution of sodium hydroxide.

The inorganic base aqueous solution is prepared as the aqueous solution of sodium hydroxide or an aqueous solution of potassium hydroxide of, for example, 0.1 to 5N (normal) preferably 0.2 to 2N (normal).

In a case that the wax, which is less likely to be dissolved in the binder resin liquid due to mixing of water, is blended, the organic base aqueous solution is preferably used in view of preventing deposition or precipitation of the wax. In this case, the organic base aqueous solution is prepared as a solution of, for example, 0.1 to 5N (normal) preferably 0.2 to 2N (normal).

In order to prepare the second water base medium in the second preparation process, the inorganic base aqueous solution is blended at a blending ratio of, for example, 0.1 to 40 parts by mass and preferably 1 to 20 parts by bass with respect to 100 parts by mass of water.

In order to prepare the second water base medium in the second preparation process, the organic base aqueous solution is blended at a blending ratio of, for example, 0.5 to 20 parts by mass and preferably 1 to 10 parts by bass with respect to 100 parts by mass of water.

(4-3) Preparation of Second Emulsion

In order to prepare the second emulsion, the binder resin liquid is blended at a blending ratio of, for example, 50 to 150 parts by mass and preferably 80 to 120 parts by bass with respect to 100 parts by mass of the second water base medium.

In a case that the wax is contained in the binder resin liquid, the binder resin liquid and the second water base medium are blended within a temperature range that the temperature is not less than a temperature at which the wax is soluble and is less than a boiling point of the second organic solvent, for example, 30 to 90° C., preferably 40 to 80° C.

Thereafter, the second water base medium in which the binder resin liquid is blended is stirred, for example, by the stirrer or agitator having a turbine blade and/or a propeller blade such as a three-one motor; the high-speed dispersing machine such as a homogenizer of rotor stator type; and/or the dispersing machine such as the high pressure homogenizer.

In a case that the second water base medium in which the binder resin is blended is stirred by the high-speed dispersing machine such as the homogenizer, the tip peripheral speed is, for example, 5 to 20 m/s and preferably 7 to 14 m/s, and the stirring time is, for example, 10 to 120 minutes and preferably 15 to 60 minutes.

Accordingly, the binder resin liquid, which is in a form of liquid droplets of 100 to 1000 nm, is emulsified in the second water base medium to prepare the second emulsion.

In the preparation of the second emulsion, the binder resin liquid may be blended with the second water base medium. Alternatively, the second water base medium may be blended with the binder resin liquid. In a case that the second water based medium is blended with the binder resin liquid, it is also possible to use a phase inversion emulsifying method. In the usual phase inversion emulsifying method, since a small amount of the second water base medium is added stepwise to the binder resin liquid, a lot of time is required for emulsification. According to the present teaching, however, it is possible to increase a velocity at which the second water base medium is added and thus it is possible to improve productivity.

Further, the following manners are also allowable. That is, neutralization is performed by blending the alkaline aqueous solution with the binder resin liquid in advance, and then water is blended with neutralized one. Alternatively, water is blended with the binder resin liquid which is neutralized in advance.

(5) Preparation of Mother Fine Particle Suspension

Subsequently, the second organic solvent is removed from the second emulsion to obtain the suspension of the mother fine particles in which the mother fine particles containing the binder resin, the colorant, and the wax are dispersed. The second organic solvent can be removed from the second emulsion in a similar manner to that in the preparation of the electrification control resin fine particle suspension.

In this preparation process, a suspension of the toner mother particles (as will be described later) may be prepared without volatilization of the second organic solvent. In this case, the mother fine particles are aggregated and fused to be in a form of the liquid droplets having sizes of the toner mother particles (as will be described later), and then the second organic solvent is removed by a method including, for example, the blowing, the heating, and the pressure reduction.

The solid content concentration in the obtained mother fine particle suspension (concentration of the mother fine particles in the suspension of the mother fine particles) is, for example, 5 to 50% by mass and preferably 10 to 35% by mass. The volume average particle diameter of the mother fine particles in the mother fine particle suspension is, for example, 30 to 1000 nm, preferably 50 to 500 nm as the median diameter.

3. Third Preparation Process

At first, the suspension of the mother fine particles is diluted with a third water base medium so that the solid content concentration is, for example, 1 to 30% by mass and preferably 5 to 20% by mass. The third water base medium is exemplified, for example, by the water base medium which is the same as that in the first or second preparation process (first or second water base medium).

In a case that the suspension of the mother fine particles is diluted, the surfactant can be added together with the third water base medium as needed. In a case that the surfactant is added to the suspension of the mother fine particles, it is allowable that a surfactant aqueous solution is previously prepared and that the surfactant aqueous solution is added to the suspension of the mother fine particles.

Those usable as the surfactant include, for example, polyoxyethylene polyoxypropyrene glycol (for example, polyoxyethylene polyoxypropyrene block copolymer), polyoxyalkylene decyl ether, polyoxyalkylene tridecyl ether, polyoxyethylene isodecyl ether, polyoxyalkylene lauryl ether, and polyoxyethylene alkyl ether. Preferably, polyoxyethylene polyoxypropyrene glycol is exemplified.

In a case that the surfactant is added to the suspension of the mother fine particles, the surfactant is blended, for example, at a blending ratio of 0.5 to 20 parts by mass and preferably 1 to 10 parts by mass with respect to 100 parts by mass of the solid content of the suspension of the mother fine particles.

Subsequently, a coagulant or coagulating agent is added to the suspension of the mother fine particles to coagulate the mother fine particles. After that, the coagulated mother fine particles are united (fused) by the heating to grow particle diameters of the mother fine particles. Accordingly, the suspension of the toner mother particles in which the toner mother particles are dispersed is prepared (third preparation process, step S3).

The coagulant is exemplified, for example, by inorganic metal salts such as aluminum chloride, calcium nitrate and the like; and polymers of inorganic metal salts such as polyaluminum chloride and the like.

In order to aggregate the mother fine particles, an aqueous solution of the coagulant prepared as, for example, 0.01 to 1.0N (normal) preferably 0.05 to 0.5N (normal) is added at a ratio of, for example, 0.1 to 10 parts by mass and preferably 0.5 to 5 parts by mass with respect to 100 parts by mass of the mother fine particle suspension, and then is stirred.

The mother fine particle suspension to which the coagulant is added is stirred as follows. That is, for example, at first, the coagulant is dispersed in the mother fine particle suspension by the high-speed dispersing machine such as the homogenizer. Then, the mother fine particle suspension to which the coagulant is added is stirred by the stirrer. The stirrer is exemplified, for example, by a stirrer provided with a stirring blade or vane which is a flat plate turbine blade, a propeller blade, an anchor blade, and the like. Instead of the stirrer, the mother fine particle suspension can be stirred by an ultrasonic dispersing machine.

The liquid temperature of the mother fine particle suspension at the time of adding the coagulant is, for example, 10 to 60° C., preferably 20 to 40° C. The stirring time by the stirrer is, for example, 5 to 60 minutes preferably 10 to 40 minutes.

Then, the mother fine particle suspension is heated at a temperature to an extent not fusing the mother fine particles (in particular, a temperature not more than a glass transition temperature of the binder resin), as needed, to uniformize the coagulation state of the mother fine particles. The heating temperature is, for example, 35 to 60° C.

Thereafter, a coagulation stopper or coagulating stopping agent is added to the suspension of the mother fine particles to stop the coagulation of the mother fine particles.

The coagulation stopper is exemplified, for example, by hydroxide of alkali metal such as sodium hydroxide, potassium hydroxide, and the like. It is also possible to use an ionic surfactant.

In the addition of the coagulation stopper, an aqueous solution of the coagulation stopper prepared as, for example, 0.01 to 5.0N (normal) preferably 0.1 to 2.0N (normal) is added at a ratio of, for example, 0.5 to 20 parts by mass and preferably 1.0 to 10 parts by mass with respect to 100 parts by mass of the mother fine particle suspension, and stirring is continued.

Then, aggregated mother fine particles are fused by heating the suspension of the mother fine particles.

In order to fuse the aggregated mother fine particles, the suspension of the mother fine particles is heated at the temperature not less than the glass transition temperature of the mother fine particles, while performing the stirring, until the mother fine particles are fused to be a desired shape.

At this time, the heating temperature is, for example, 55 to 100° C. and preferably 65 to 98° C. Although it depends on types of binder resins, a heating time is, for example, 0.5 to 10 hours.

In a case that the heating time is short, it is possible to obtain the toner mother particles each having irregular shape (which is not spherical). In a case that the heating time is long, it is possible to obtain the toner mother particles each having a spherical shape.

As described above, the aggregated mother fine particles are fused to form the toner mother particles. Accordingly, the suspension of the toner mother particles in which the toner mother particles are dispersed is prepared. The toner mother particles contain the binder resin, the colorant, and the wax.

Thereafter, the suspension of the toner mother particles is cooled and reverse-neutralization is performed by acid, as needed.

In order to perform the reverse-neutralization, inorganic acid such as hydrochloric acid, sulfuric acid, and nitric acid is prepared as an aqueous solution of, for example, 0.01 to 5N (normal) preferably 0.1 to 2N (normal). Then, the aqueous solution is added at a ratio of, for example, 0.05 to 2 parts by mass and preferably 0.1 to 1 part by mass with respect to 100 parts by mass of the suspension. Thereafter, the aqueous solution is stirred to an extent that the suspension flows, for 10 to 180 minutes and preferably 15 to 120 minutes.

The volume-based average particle diameter of the toner mother particles (Dv, measurement is performed by a method described in Examples as will be described later on) is, for example, 3 to 12 μm and preferably 6 to 10 μm. The number-based average particle diameter of the toner mother particles (Dn, measurement is performed by a method described in Examples as will be described later on) is, for example, 2 to 11 μm preferably 5 to 9 μm.

The glass transition temperature of the toner mother particles (Tg, measurement is performed by a method described in Examples as will be described later on) is, for example, 20 to 80° C. and preferably 40 to 60° C.

The toner mother particles are prepared such that the amount of anionic group existing on the surfaces of the toner mother particles (anion equivalent, measurement is performed by a method described in Examples as will be described later on) is, for example, not more than $3\times10^{-5}$ mol/g, preferably not more than $1\times10^{-5}$ mol/g and is more than 0 mol/g.

The major anionic group existing on the surfaces of the toner mother particles is exemplified, for example, by the carboxyl group of the binder resin which is a main component of the toner. Thus, by adjusting the type and content of the binder resin contained in the toner, surface areas of the toner mother particles, and the like, it is possible to adjust the anion equivalent of the toner mother particles.

Alternately, the toner mother particles are prepared such that a difference calculated by subtracting the anion equivalent from the cation equivalent of the toner mother particles (measurement is performed by a method described in Examples as will be described later on) is, for example, $-3.0\times10^{-5}$ to $2\times10^{-6}$ mol/g and preferably $-1.1\times10^{-5}$ to $1\times10^{-6}$ mol/g.

In addition to the anionic group such as the carboxyl group, the cationic group also exists on the surfaces of the toner mother particles. The difference calculated by subtracting the anion equivalent from the cation equivalent of the toner mother particles can be adjusted by adjusting the type and composition ratio of a substance composing the toner, the surface areas of the toner mother particles, and the like.

The toner mother particles are preferably prepared as follows; the anion equivalent is not more than $1\times10^{-5}$ mol/g and is more than 0 mol/g, and the difference calculated by subtracting the anion equivalent from the cation equivalent is $-1.1\times10^{-5}$ to $-1\times10^{-6}$ mol/g.

4. Preparation of Toner (1) Preparation of Mixture Liquid of Suspension of Fine Particles of Electrification Control Resin and Suspension of Toner Mother Particles In the method for producing the toner according to the present teaching, then, the suspension of the fine particles of the electrification control resin (the electrification control resin fine particle suspension) and the suspension of the toner mother particles (the toner mother particle suspension) are mixed with each other to prepare the mixture liquid (mixing process, step S4).

Accordingly, it is possible to produce the toner of the present teaching in good yield.

A method for mixing the suspension of the fine particles of the electrification control resin and the suspension of the toner mother particles is not especially limited. For example, the suspension of the toner mother particles and the suspension of the fine particles of the electrification control resin are blended, followed by being stirred as appropriate.

In a case that the mixture liquid is prepared, the suspension of the toner mother particles and the suspension of the fine particles of the electrification control resin are blended in such a blending ratio that the solid content of the suspension of the fine particles of the electrification control resin (i.e., fine particles of electrification control resin) is, for example, 0.2 to 10 parts by mass, preferably 0.2 to 5 parts by mass with respect to the 100 parts by mass of the solid content of the suspension of the toner mother particles (i.e., the toner mother particles).

In a case that the ratio of the fine particles of the electrification control resin in the mixture liquid is lower than the ratio as described above, since the amount of the electrification control resin existing on the surfaces of the toner mother particles is insufficient, electrification performance can not be obtained sufficiently in some cases. On the other hand, in a case that the ratio of the fine particles of the electrification control resin in the mixture liquid is higher than the ratio as described above, charge-up and the like is caused and uniformity of the electrification of the toner is adversely affected in some cases. Also in this case, the stability of the electrification of the toner may be decreased. In a case that the ratio of the fine particles of the electrification control resin in the mixture liquid is within the ratio as described above, the electrification performance of the toner can be further stabilized.

In a case that the suspension of the toner mother particles and the suspension of the fine particles of the electrification control resin are mixed with each other, the stirring is performed by the stirrer such as the three-one motor to an extent that the mixture liquid as a whole flows. It is possible to use, as the stirring blade or vane, a publicly known stirring blade or vane including, for example, the flat plate turbine blade, the propeller blade, and the anchor blade.

Accordingly, the fine particles of the electrification control resin are electrostatically attached to the toner mother particles in the mixture liquid.

In the method for producing the toner according to the present teaching, then, the mixture liquid of the suspension of the fine particles of the electrification control resin and the suspension of the toner mother particles is heated.

In a case that the mixture liquid is heated, the mixture liquid is stirred for, for example, 5 to 60 minutes, preferably 10 to 30 minutes while maintaining the heating temperature at, for example, 30 to 65° C. preferably 40 to 55° C.

Accordingly, it is possible to fix and fuse the fine particles of the electrification control resin on the surfaces of the toner mother particles.

(2) External Additive

After that, an external additive is added if necessary. The external additive is added in order to adjust, for example, the electrification performance, the fluidity, and the storage stability of the toner. The external additive is composed of very fine particles each having a particle diameter (particle size) which is extremely smaller than that of each toner mother particle.

The external additive is exemplified, for example, by inorganic particles and synthetic resin particles.

The inorganic particles are exemplified, for example, by silica, aluminum oxide, titanium oxide, silicon aluminum cooxide, silicon titanium cooxide, hydrophobic treated material thereof, and the like. For example, the hydrophobic treated material of silica can be obtained by treating fine powder of silica with silicone oil and/or silane coupling agent (for example, dichlorodimethylsilane, hexamethyldisilazane, and tetramethyldisilazane).

The synthetic resin particles are exemplified, for example, by methacrylic acid ester polymer particles, acrylic acid ester polymer particles, styrene-methacrylic acid ester copolymer particles, styrene-acrylic acid ester copolymer particles, core-shell type particles having core composed of styrene polymer and shell composed of methacrylic acid ester polymer, and the like.

The method for adding the external additive is not especially limited. The toner obtained as described above and the external additive are mixed while performing agitation by using, for example, a high-speed stirring machine such as a henschel mixer. The amount of addition of the external additive is not especially limited. However, the external additive is normally added in an amount of 0.1 to 6 parts by mass with respect to 100 parts by mass of the toner obtained as described above.

As described above, according to the method for producing the toner of the present teaching, the toner is produced by mixing the toner mother particle suspension in which the toner mother particles containing the wax having the characteristics (I) to (III) are dispersed and the suspension of fine particles of electrification control resin in which the fine particles of the electrification control resin are dispersed.

Therefore, it is possible to provide the toner which is capable of improving the releasing performance with respect to the fixing member and the fixing performance with respect to the recording medium at low temperature.

Further, according to the method for producing the toner of the present teaching, the anion equivalent of the toner mother particles is not more than $1\times10^{-5}$ mol/g and is more than 0 mol/g, or the difference calculated by subtracting the anion equivalent from the cation equivalent of the toner mother particles is $-1.1\times10^{-5}$ to $-1\times10^{-6}$ mol/g.

Therefore, it is possible to fix the fine particles of the electrification control resin to the toner mother particles while preventing the toner mother particles from being united and aggregated with each other in the mixing process. By adjusting the surfaces of the toner mother particles as described above, it is possible to prevent the aggregation of the toner mother particles via the fine particles of the electrification control resin while maintaining the sufficient electrification performance of the toner, and as a result, it is possible to increase the yield of the toner.

4. Toner

In the method for producing the toner according to the present teaching, since the anion equivalent of the toner mother particles or the difference calculated by subtracting the anion equivalent from the cation equivalent of the toner mother particles is within the range as described above, it is possible to fix the fine particles of the electrification control resin to the toner mother particles while preventing the toner mother particles from being united and aggregated with each other in the mixing process.

Further, the toner obtained by the method for producing the toner as described above contains the wax as follows. That is, the difference between density of the wax in the solid state and density of the wax melted to be the liquid state is not less than 0.11 g/cm$^3$; the density of the wax melted to be the liquid state is not more than 0.835 g/cm$^3$; heat quantity of the wax per unit mass, which is obtained from the endothermic peak area at the low temperature side measured by the differential scanning calorimetry, is not less than 190 mJ/mg.

Thus, it is possible to improve the releasing performance with respect to the fixing member and the fixing performance with respect to the recording medium at the low temperature.

EXAMPLES

The method for producing a positively chargeable toner will be explained below more specifically as exemplified by Examples. In the following explanation, the "part" and "%" are based on the mass, unless specifically noted. Various physical properties were measured in accordance with the measurement methods as described later on.

1. First Preparation Process (1) Preparation of Electrification Control Resin Fine Particle Suspension A (1-1) Electrification Control Resin A An electrification control resin A (product name: "FCA-201PS", produced by Fujikura Kasei Co., Ltd.) was prepared.

The electrification control resin A was copolymer of butyl acrylate, N,N-diethyl-N-methyl-2-(methacryloyloxy) ethylammonium=p-toluenesulfonate, and styrene (N,N-diethyl-N-methyl-2-(methacryloyloxy)ethylammonium=p-toluenesulfonate content: 14% by mass), weight average molecular weight (Mw): 15000, glass transition temperature (Tg): 66° C.

(1-2) Preparation of Electrification Control Resin Fine Particle Suspension A

MEK and the electrification control resin A were mixed and stirred at the blending ratio as shown in Table 1, and the electrification control resin A was dissolved in MEK to obtain an electrification control resin liquid.

100 parts by mass of distilled water was mixed with 100 parts by mass of the electrification control resin liquid, followed by being stirred and emulsified for 20 minutes at a number of revolutions as shown in Table 1 by using a homogenizer (rotor stator type, shaft 18F, rotor diameter: 12.5 mm, DIAX-900 type, produced by Heidolph) to obtain a first emulsion A.

The obtained first emulsion A was transferred to a 1 L separable flask, and MEK was volatilized and removed by performing the heating and the stirring for the time as shown in Table 1, at the temperature as shown in Table 1 while feeding nitrogen to the gaseous phase to obtain the electrification control resin fine particle suspension A in which the fine particles of the electrification control resin A were dispersed.

The solid content concentration of the electrification control resin fine particle suspension A, the volume average particle diameter (median diameter: D50) of the fine particles of the electrification control resin A in the electrification control resin fine particle suspension A, and the amount of the cationic group (cation equivalent) existing on the surfaces of the fine particles of the electrification control resin A are shown in Table 1.

(2) Preparation of Electrification Control Resin Fine Particle Suspension B

The electrification control resin fine particle suspension B in which the fine particles of the electrification control resin A were dispersed was prepared in the same manner as the preparation of the electrification control resin fine particle suspension A as described above, except that the materials were blended at the blending ratios as shown in Table 1, followed by heated and stirred for the time as shown in Table 1, at the temperature as shown in Table 1.

The solid content concentration of the electrification control resin fine particle suspension B, the volume average particle diameter (median diameter: D50) of the fine particles of the electrification control resin A in the electrification control resin fine particle suspension B, and the amount of the cationic group (cation equivalent) existing on the surfaces of the fine particles of the electrification control resin A are shown in Table 1.

(3) Preparation of Electrification Control Resin Fine Particle Suspension C (3-1) Electrification Control Resin B 285 parts by mass of styrene monomer, 15 parts by mass of acryl monomer (methyl chloride quaternary salt of dimethylaminoethyl methacrylate (ACRYESTER DMC, produced by Mitsubishi Rayon Co., Ltd.)), 5 parts by mass of azo-based polymerization initiator (V65, produced by Wako Pure Chemical Industries, Ltd.), 50 parts by mass of MEK (methyl ethyl ketone), and 150 parts by mass of methanol were charged in a 1 L separable flask.

Then, nitrogen gas was blown at the flow rate of 50 ml/min, and bubbling was performed for 30 minutes. Further, the separable flask was heated to a temperature of 65° C. while feeding the nitrogen gas to the gaseous phase at the flow rate of 30 ml/min.

After that, solution polymerization was performed for about 10 hours while performing the agitation by using a crescent-shaped impeller at a number of revolutions of 100 rpm. A solvent portion (MEK and/or unreacted monomer) was removed from the obtained electrification control resin liquid by heating under reduced pressure to obtain the electrification control resin B composed of acryl-styrene-based resin containing the quaternary ammonium salt-containing group.

In the electrification control resin B, the weight average molecular weight (Mw) was 9030 and the glass transition temperature (Tg) was 92.7° C.

(3-2) Preparation of Electrification Control Resin Fine Particle Suspension C

The electrification control resin fine particle suspension C was prepared in the same manner as the preparation of the electrification control resin fine particle suspension A as described above, except that the electrification control resin B was used instead of the electrification control resin A, followed by heated and stirred for the time as shown in Table 1, at the temperature as shown in Table 1.

The solid content concentration of the electrification control resin fine particle suspension C, the volume average particle diameter (median diameter: D50) of the fine particles of the electrification control resin B in the electrification control resin fine particle suspension C, and the amount of the cationic group (cation equivalent) existing on the surfaces of the fine particles of the electrification control resin B are shown in Table 1.

(4) Preparation of Electrification Control Resin Fine Particle Suspensions D and E The electrification control resin fine particle suspensions D and E were prepared in the same manner as the preparation of the electrification control resin fine particle suspension C as described above, except that the materials were blended at the blending ratios as shown in Table 1, followed by stirred at the number of revolutions as shown in Table 1.

The solid content concentration of each of the electrification control resin fine particle suspensions D and E, the volume average particle diameter (median diameter: D50) of the fine particles of the electrification control resin B in each of the electrification control resin fine particle suspensions D and E, and the amount of the cationic group (cation equivalent) existing on the surfaces of the fine particles of the electrification control resin B are shown in Table 1.

2. Preparation of Wax (1) Preparation of Wax A 81 parts by mass of stearic acid and 76 parts by mass of stearyl alcohol were charged in a four-necked flask to which a thermometer, a stirring blade, a cooling tube, and a nitrogen inlet tube were attached, followed by being reacted for 15 hours while removing reaction water at 230° C. under a nitrogen gas flow.

50 parts by mass of toluene and 20 parts by mass of ethanol were added to 100 parts by mass of the obtained crude product, and further 10% aqueous solution of potassium hydroxide was added. After performing the agitation for 30 minutes at 70 to 80° C., the water layer was removed.

Subsequently, 30 parts by mass of distilled water at 70 to 80° C. was added to 100 parts by mass of the crude product. After performing the agitation for 30 minutes, the water layer was removed. Then, a wash by the distilled water was repeated in the same manner until pH of the water layer was neutralized.

The obtained oil layer (ester, stearic acid stearyl) was placed at a temperature of 180° C. under a condition of pressure reduction of 1 kPa to remove the solvent. Physical properties of the wax are shown in Tables 2 and 3.

(2) Preparation of Wax B

An ester-based wax B (stearic acid behenyl) was prepared in the same manner as the preparation of the ester-based wax A, except that 73 parts by mass of stearic acid and 83 parts by mass of behenyl alcohol were used instead of 81 parts by mass of stearic acid and 76 parts by mass of stearyl alcohol. The physical properties of the wax are shown in Tables 2 and 3.

(3) Preparation of Wax C

An ester-based wax C (heneicosanoic acid behenyl) was prepared in the same manner as the preparation of the ester-based wax A, except that 80 parts by mass of heneicosanoic acid and 78 parts by mass of behenyl alcohol were used instead of 81 parts by mass of stearic acid and 76 parts by mass of stearyl alcohol. The physical properties of the wax are shown in Tables 2 and 3.

(4) Preparation of Wax D

An ester-based wax D (dipentaerythritol hexamyristate and myristic acid behenyl) was prepared in the same manner as the preparation of the ester-based wax A, except that 238 parts by mass of myristic acid, 37 parts by mass of dipentaerythritol, and 48 parts by mass of behenyl alcohol were used instead of 81 parts by mass of stearic acid and 76 parts by mass of stearyl alcohol. The physical properties of the wax are shown in Tables 2 and 3.

(5) Preparation of Waxes E to J

For a comparative experiment, a wax E (ester-based; product name "WEP4", produced by NOF CORPORATION), a wax F (ester-based; product name "WEP5", produced by NOF CORPORATION), a wax G (ester-based; product name "WEP6", produced by NOF CORPORATION), a wax H (ester-based; product name "WEP476R", produced by NOF CORPORATION), a wax I (amide-based; product name "WA-1", produced by NOF CORPORATION), and a wax J (amide-based; product name "WA-2", produced by NOF CORPORATION) were prepared. The physical properties of the waxes are shown in Tables 2 and 3.

3. Second Preparation Process (1) Preparation of Colorant Dispersion (1-1) Preparation of Colorant Dispersion A 15 parts by mass of polyester resin (FC1565, Tg: 62° C., Mn (number average molecular weight): 3600, Mw (weight average molecular weight): 50000, gel content: less than 2 wt %, acid value: 6.0 KOH mg/g, produced by Mitsubishi Rayon Co. Ltd.), 15 parts by mass of carbon black (#260, produced by Mitsubishi Chemical Corporation), and 70 parts by mass of MEK were mixed with each other and stirred for 10 minutes at a number of revolutions of 10000 rpm by means of a homogenizer (Silent Crusher M, shaft 18F, produced by Heidolph). As described above, the colorant was preliminary dispersed.

Then, 100 parts by mass of the preliminary dispersion of the colorant was introduced into a bead mill (RMB-04, produced by IMEX Co., Ltd) together with 450 parts by mass of zirconia beads (diameter: 1 mm), followed by being treated for 60 minutes at a stirring velocity of 2000 rpm to obtain the colorant dispersion A.

(1-2) Preparation of Colorant Dispersion B

The colorant dispersion B was prepared in the same manner as the preparation of the colorant dispersion A, except that the polyester resin (ER508, Tg: 63° C., Mn (number average molecular weight): 3700, Mw (weight average molecular weight): 113000, gel content: less than 2 wt %, acid value: 8.0 KOH mg/g, produced by Mitsubishi Rayon Co. Ltd.) was used instead of FC1565.

(2) Preparation of Mother Fine Particle Suspension (Suspension of Mother Fine Particles)

(2-1) Preparation of Mother Fine Particle Suspension A

After 678 parts by mass of MEK was slowly mixed with 60 parts by mass of the colorant dispersion as shown in Table 4, the binder resin and the wax were further mixed and stirred at the blending ratio as shown in Table 4, and the mixture was heated and stirred to a liquid temperature of 70° C. to obtain the binder resin liquid.

900 parts by mass of the obtained binder resin liquid, 900 parts by mass of distilled water, and 9.0 parts by mass of 1 N aqueous sodium hydroxide solution were mixed with each other. The mixture was stirred and emulsified for 20 minutes at a number of revolutions of 15000 rpm by means of the homogenizer to obtain a second emulsion A.

The second emulsion A was transferred to a 2 L separable flask, and MEK was removed by performing the heating and the stirring for the time as shown in Table 4, at the temperature of 80° C. while feeding nitrogen to the gaseous phase to obtain the mother fine particle suspension A in which the mother fine particles were dispersed.

The solid content concentration of the mother fine particle suspension A and the volume average particle diameter (median diameter: D50) of the mother fine particles in the mother fine particle suspension A are shown in Table 4.

(2-2) Preparation of Mother Fine Particle Suspensions B to Q

The mother fine particle suspensions B to Q were prepared in the same manner as the preparation of the mother fine particle suspension A, except that materials were blended at each blending ratio as shown in Table 4, followed by heated and stirred for each time as shown in Table 4.

The solid content concentration of each of the mother fine particle suspensions B to Q and the volume average particle diameter (median diameter: D50) of the mother fine particles in each of the mother fine particle suspensions B to Q are shown in Table 4.

3. Third Preparation Process (1) Preparation of Toner Mother Particle Suspension A Subsequently, the mother fine particle suspension A and 57.6 parts by mass of 5% aqueous solution of nonionic surfactant (Epan-785, polyoxyethylene polyoxypropylene block copolymers, produced by Dai-ichi Kogyo Seiyaku Co. Ltd.) were mixed with each other at the blending ratio as shown in Table 5, followed by being diluted with 956.5 parts by mass of distilled water to prepare 1600 parts by mass of a diluted liquid of the mother fine particle suspension A having a solid content concentration of 10%.

35 parts by mass of 0.2 N aluminum chloride aqueous solution was added as a coagulant to the diluted liquid, followed by being mixed at a high speed for 10 minutes at a number of revolutions of 8000 rpm by means of a homogenizer.

After that, the diluted liquid was transferred to a 2 L separable flask, and was heated for 30 minutes at 45° C. while being stirred with six flat plate turbine blades (ϕ75 mm) at a number of revolutions of 300 rpm to coagulate the fine particles. Then, 46 parts by mass of 0.2 N sodium hydroxide aqueous solution was introduced as a coagulation stopper, followed by being heated and stirred for the time as shown in Table 5 at 98° C. to prepare the toner mother particles A so that the mother fine particles each had a spherical shape. Accordingly, the suspension of the toner mother particles A was obtained.

The suspension of the toner mother particles A obtained was filtrated and the toner mother particles A filtered off were washed with distilled water, followed by being introduced into the separable flask. The distilled water was added into the separable flask to redisperse the toner mother particles A. Accordingly, 1600 parts by mass of the toner mother fine particle suspension A (160 parts by mass as the toner mother particles) having a solid content concentration of 10% by mass was obtained.

The volume-based average particle diameter of the toner mother particles A (Dv), the number-based average particle diameter of the toner mother particles A (Dn), the glass transition temperature (Tg) of the toner mother particles A, the anion equivalent of the toner mother particles A, and the difference calculated by subtracting the anion equivalent from the cation equivalent of the toner mother particles A are shown in Table 5.

(2) Preparation of Toner Mother Particle Suspensions B to Q

The toner mother particle suspensions B to Q were prepared in the same manner as the preparation of the toner mother particle suspension A, except that materials were blended at each blending ratio as shown in Table 5, followed by being heated and stirred under each condition in which the mother fine particles each had the spherical shape as shown in Table 5.

The volume-based average particle diameter of each of the toner mother particles B to Q (Dv), the number-based average particle diameter of each of the toner mother particles B to Q (Dn), the glass transition temperature (Tg) of each of the toner mother particles B to Q, the anion equivalent of each of the toner mother particles B to Q, and the difference calculated by subtracting the anion equivalent from the cation equivalent of each of the toner mother particles B to Q are shown in Table 5.

4. Preparation of Toner (1) Example 1

In a hot-water bath at 46° C., 41 parts by mass of (8 parts by mass as the fine particles of the electrification control resin A) the suspension of the fine particles of the electrification control resin A in which the fine particles of the electrification control resin A were dispersed (solid content concentration; 19.5% by mass) was blended with 1600 parts by mass of (160 parts by mass as the toner mother particles A) the toner mother particle suspension A having the solid content concentration of 10% by mass while performing the agitation at 200 rpm by using an impeller (double six flat plate turbine blades, diameter: 75 mm), followed by being stirred for 20 minutes to prepare a mixture liquid (mixing process).

Thereafter, the separable flask containing the mixture liquid was immersed in cold water and was cooled. Then, the mixture liquid was filtered with a mesh of 150 μm. Further, distilled water was added to the toner particles filtered off to filter off only the toner particles (coarse particles) which did not pass through the mesh, and then the filtrate was recovered completely.

Subsequently, the recovered filtrate was filtered with a paper filter of 4 μm. Further, distilled water was added to the toner particles filtered off and the filtration (wash) was repeatedly performed until electrical conductivity of the filtrate was not more than 4 μS/cm. Then, this filtrate was recovered.

In a case that moisture in the filtrate was completely evaporated, the amount of solid content in the filtrate which passed through the paper filter was 6.6 parts by mass.

In this situation, the amount of the fine particles of the electrification control resin A, which fixed to the toner mother particles, was calculated from the following expression.

(The amount of the fine particles of the electrification control resin *A* in the mixture liquid(8 parts by mass))−(the amount of the solid content in the filtrate which passed through the paper filter(6.6 parts by mass))=(the amount of the fine particles of the electrification control resin *A* which fixed to the toner mother particles(1.4 parts by mass) (*W*3)) Expression:

Here, the yield of the toner particles was calculated from the following expression.

Expression: Yield of toner particles (%) =

$$\{1-(W2\text{: 74.8 parts by mass}-W1\text{: 43 parts by mass})/(160\text{ parts by mass}+W3\text{: 1.4 parts by mass})\}\times 100=80.3\text{ wt }\%$$

Weight of the solid content of the toner mother particles: 160 parts by mass

W1: Dry weight of the mesh before the coarse particles are recovered

W2: Weight measured after the mesh which trapped the coarse particles is put in a drying machine to remove the moisture W3: Weight of the fine particles of the electrification control resin fixing to the toner mother particles The yield of the toner particles obtained by the above expression was evaluated based on the following criteria. Evaluation results are shown in Table 6.

<Evaluation Criteria of Yield of Toner Particles>

+++: not less than 95 wt %

++: not less than 88 wt % and less than 95 wt %

+: less than 88 wt %

Thereafter, 1 part by mass of HVK2150 (hydrophobic silica, produced by Clariant) and 1 part by mass of NA50H (hydrophobic silica, produced by Aerosil) were blended with respect 100 parts by mass of the toner particles, followed by performing the agitation for 3 minutes at a number of revolutions of 2500 rpm by using a MECHANOMILL (produced by OKADA SEIKO CO., LTD.). Then, coarse aggregate matter of the hydrophobic silica was removed by using a sieve to obtain the toner. Physical properties are shown in Table 6.

(2) Example 2

The toner was obtained in the same manner as Example 1, except that the toner mother particle suspension B was used instead of the toner mother particle suspension A and that treatment was performed in a hot-water bath at the temperature as shown in Table 6. Physical properties are shown in Table 6.

(3) Example 3

The toner was obtained in the same manner as Example 1, except that the toner mother particle suspension C was used instead of the toner mother particle suspension A and that treatment was performed in a hot-water bath at the temperature as shown in Table 6. Physical properties are shown in Table 6.

(4) Example 4

The toner was obtained in the same manner as Example 1, except that the toner mother particle suspension C was used instead of the toner mother particle suspension A, that the electrification control resin fine particle suspension B were used instead of the electrification control resin fine particle suspension A, and that treatment was performed in a hot-water bath at the temperature as shown in Table 6. Physical properties are shown in Table 6.

(5) Example 5

The toner was obtained in the same manner as Example 1, except that the toner mother particle suspension C was used instead of the toner mother particle suspension A, that the electrification control resin fine particle suspension C were used instead of the electrification control resin fine particle suspension A, and that treatment was performed in a hot-water bath at the temperature as shown in Table 6. Physical properties are shown in Table 6.

(6) Example 6

The toner was obtained in the same manner as Example 1, except that the toner mother particle suspension C was used instead of the toner mother particle suspension A, that the electrification control resin fine particle suspension D were used instead of the electrification control resin fine particle suspension A, and that treatment was performed in a hot-water bath at the temperature as shown in Table 6. Physical properties are shown in Table 6.

(7) Example 7

The toner was obtained in the same manner as Example 1, except that the electrification control resin fine particle suspension D were used instead of the electrification control resin fine particle suspension A and that treatment was performed in a hot-water bath at the temperature as shown in Table 6. Physical properties are shown in Table 6.

(8) Example 8

The toner was obtained in the same manner as Example 1, except that the toner mother particle suspension D was used instead of the toner mother particle suspension A, that the electrification control resin fine particle suspension D were used instead of the electrification control resin fine particle suspension A, and that treatment was performed in a hot-water bath at the temperature as shown in Table 6. Physical properties are shown in Table 6.

(9) Example 9

The toner was obtained in the same manner as Example 1, except that the toner mother particle suspension F was used instead of the toner mother particle suspension A and that treatment was performed in a hot-water bath at the temperature as shown in Table 6. Physical properties are shown in Table 6.

(10) Example 10

The toner was obtained in the same manner as Example 1, except that the toner mother particle suspension G was used instead of the toner mother particle suspension A and that treatment was performed in a hot-water bath at the temperature as shown in Table 6. Physical properties are shown in Table 6.

(11) Example 11

The toner was obtained in the same manner as Example 1, except that the toner mother particle suspension G was used instead of the toner mother particle suspension A, that the electrification control resin fine particle suspension C were used instead of the electrification control resin fine particle suspension A, and that treatment was performed in a hot-water bath at the temperature as shown in Table 6. Physical properties are shown in Table 6.

(12) Example 12

The toner was obtained in the same manner as Example 1, except that the toner mother particle suspension H was used instead of the toner mother particle suspension A and that treatment was performed in a hot-water bath at the temperature as shown in Table 6. Physical properties are shown in Table 6.

(13) Example 13

The toner was obtained in the same manner as Example 1, except that the toner mother particle suspension I was used instead of the toner mother particle suspension A, that the electrification control resin fine particle suspension D were used instead of the electrification control resin fine particle suspension A, and that treatment was performed in a hot-water bath at the temperature as shown in Table 6. Physical properties are shown in Table 6.

(14) Example 14

The toner was obtained in the same manner as Example 1, except that the toner mother particle suspension J was used instead of the toner mother particle suspension A and that treatment was performed in a hot-water bath at the temperature as shown in Table 6. Physical properties are shown in Table 6.

(15) Example 15

The toner was obtained in the same manner as Example 1, except that the toner mother particle suspension K was used instead of the toner mother particle suspension A, that the electrification control resin fine particle suspension D were used instead of the electrification control resin fine particle suspension A, and that treatment was performed in a hot-water bath at the temperature as shown in Table 6. Physical properties are shown in Table 6.

(16) Comparative Example 1

The toner was obtained in the same manner as Example 1, except that the toner mother particle suspension L was used instead of the toner mother particle suspension A and that treatment was performed in a hot-water bath at the temperature as shown in Table 6. Physical properties are shown in Table 6.

(17) Comparative Example 2

The toner was obtained in the same manner as Example 1, except that the toner mother particle suspension M was used instead of the toner mother particle suspension A and that treatment was performed in a hot-water bath at the temperature as shown in Table 6. Physical properties are shown in Table 6.

(18) Comparative Example 3

The toner was obtained in the same manner as Example 1, except that the toner mother particle suspension N was used instead of the toner mother particle suspension A and that treatment was performed in a hot-water bath at the temperature as shown in Table 6. Physical properties are shown in Table 6.

(19) Comparative Example 4

The toner was obtained in the same manner as Example 1, except that the toner mother particle suspension O was used instead of the toner mother particle suspension A and that treatment was performed in a hot-water bath at the temperature as shown in Table 6. Physical properties are shown in Table 6.

(20) Comparative Example 5

The toner was obtained in the same manner as Example 1, except that the toner mother particle suspension P was used instead of the toner mother particle suspension A and that treatment was performed in a hot-water bath at the temperature as shown in Table 6. Physical properties are shown in Table 6.

(21) Comparative Example 6

The toner was obtained in the same manner as Example 1, except that the toner mother particle suspension Q was used instead of the toner mother particle suspension A and that treatment was performed in a hot-water bath at the temperature as shown in Table 6. Physical properties are shown in Table 6.

As shown in Tables 2 to 4, and Table 6, the waxes A to D contained in the toners of Examples 1 to 15 had the characteristics (I) to (III), while the waxes E to J contained in the toners of Comparative examples 1 to 6 did not have the characteristics (I) to (III). As shown in Table 6, as a result of a test of the fixing performance of the toner, a lower limit temperature to fix the toner in each of Examples 1 to 15 was lower than those in Comparative examples 1 to 6. From this result, the following fact was revealed. That is, the toners in Examples 1 to 15 had superior fixing performance with respect to the recording medium and superior releasing performance with respect to the fixing member at the low temperatures, as compared with Comparative examples 1 to 6.

The toners in Examples 9 to 13 contained the stearic acid behenyl of the wax B or the heneicosanoic acid behenyl of the wax C (see Table 4 and Table 6). Further, as shown in Table 2, the difference between the density of the wax in the solid state and the density of the wax melted to be the liquid state was large in each of the waxes B and C (0.145 g/cm$^3$ in the wax B and 0.133 g/cm$^3$ in the wax C). As shown in Table 6, the following fact was revealed. That is, the lower limit temperatures to fix the toners in Examples 9 to 13 were especially low, and the toners in Examples 9 to 13 had superior fixing performance with respect to the recording medium and superior releasing performance with respect to the fixing member at the low temperatures.

As shown in Table 6, the evaluation results with respect to the yield of the toner particles were evaluated as "+++" in Examples 4 to 6, 8, 11, 13, and 15. In Examples 4 to 6, 8, 11, 13, and 15, the anion equivalent of the toner mother particles was not more than $1\times10^{-5}$ mol/g and was more than 0 mol/g, and the difference calculated by subtracting the anion equivalent from the cation equivalent of the toner mother particles was $-1.1\times10^{-5}$ to $-1\times10^{-6}$ mol/g. From these results, the following assumption is made. That is, in Examples 4 to 6, 8, 11, 13, and 15, since the toner mother particles had the above characteristics, the aggregation of the toner mother particles was suppressed at the time of producing the toner. Accordingly, the yield of the toner particles was improved.

(22) Reference Example 1

The toner was obtained in the same manner as Example 1, except that the toner mother particle suspension C was used instead of the toner mother particle suspension A, that the electrification control resin fine particle suspension E were used instead of the electrification control resin fine particle suspension A, and that treatment was performed in a hot-water bath at the temperature as shown in Table 6. Physical properties are shown in Table 6. In Reference example 1, the cation equivalent of the fine particles of the electrification control resin was not more than a lower limit value. The fine particles of the electrification control resin were not fixed to the toner mother particles in a sufficient amount, and thus the electrification control required to make a solid patch pattern for evaluating the fixing performance which will be described later could not be performed in Reference example 1. Therefore, the fixing performance of the toner could not be evaluated in Reference example 1.

The evaluation result of the yield of the toner particles was evaluated as "+++" (good) in Reference Example 1. With respect to this evaluation result, the following assumption is made. That is, the anion equivalent of the toner mother particles was not more than $1\times10^{-5}$ mol/g and was more than 0 mol/g, and the difference calculated by subtracting the anion equivalent from the cation equivalent of the toner mother particles was $-1.1\times10^{-5}$ to $-1\times10^{-6}$ mol/g. Thus, the aggregation of the toner mother particles was suppressed.

The wax contained in the toner of Reference example 1 had the characteristics (I) to (III). Therefore, the following assumption is made. That is, although the evaluation could not be performed by the method for testing the fixing performance of the toner according to this Reference example, when the fixing performance of the toner is evaluated by another evaluation method, the toner in Reference example 1 exhibits superior fixing performance with respect to the recording medium and superior releasing performance with respect to the fixing member at the low temperature.

(23) Reference example 2

The toner was obtained in the same manner as Example 1, except that the toner mother particle suspension E was used instead of the toner mother particle suspension A and that treatment was performed in a hot-water bath at the temperature as shown in Table 6. Physical properties are shown in Table 6. In Reference example 2, the difference calculated by subtracting the anion equivalent from the cation equivalent of the toner mother particles was not less than an upper limit value. The fine particles of the electrification control resin were not fixed to the toner mother particles in a sufficient amount, and thus the electrification control required to make the solid patch pattern for evaluating the fixing performance which will be described later could not be performed in Reference example 2. Therefore, the fixing performance of the toner could not be evaluated in Reference example 2.

The evaluation result of the yield of the toner particles was evaluated as "+++" (good) in Reference Example 2. With respect to this evaluation result, the following assumption is made. That is, the anion equivalent of the toner mother particles was not more than $1\times10^{-5}$ mol/g and was more than 0 mol/g. Thus, the aggregation of the toner mother particles was suppressed.

The wax contained in the toner of Reference example 2 had the characteristics (I) to (III). Therefore, the following assumption is made. That is, although the evaluation could not be performed by the method for testing the fixing performance of the toner according to this Reference example, when the fixing performance of the toner is evaluated by another evaluation method, the toner in Reference example 2 exhibits superior fixing performance with respect to the recording medium and superior releasing performance with respect to the fixing member at the low temperature.

5. Various Physical Tests (1) Measurement Method of Anion Equivalent and Cation Equivalent of Toner Mother Particles A flow potential measurement apparatus (Automatic Potentiometric Titrator AT-510, produced by KYOTO ELECTRONICS PRODUCING CO., LTD. (setting conditions: wait time; 300 s, cut-off time: 5 s, unit volume: 0.1 ml, dispense speed: 10 s/ml, gain: 1, data sanp. Pot: 4 mv, data sanp. vol: 0.1 ml)) was prepared.

As a titration reagent, an aqueous solution of an anion reagent (sodium lauryl sulfate, produced by Wako Pure Chemical Industries, Ltd.) having concentration of 0.004 mol/l and density of 1.00 g/ml was prepared.

As another titration reagent, an aqueous solution of a cation reagent (benzethonium chloride, produced by Wako Pure Chemical Industries, Ltd.) having concentration of 0.0016 mol/l and density of 1.00 g/ml was prepared. It has already been confirmed that the titration reagents as described above have the same inflection point provided that the titration reagents have the same concentration and the same amount.

A magnetic stirrer was placed in a beaker and was subjected to weighing. This weight was regarded as "A". Then, the toner mother particles (1 g) were charged in the beaker and subject to weighing. The weight of toner mother particles was regarded as "B".

Further, 5 ml of the aqueous solution of the anion reagent was charged into the beaker along a wall thereof by using a burette and the toner mother particles were soaked in the anion reagent while an ultrasonic wave is applied for a minute. Then, 95 g of distilled water was added. In order to prevent volatilization, the beaker was covered with a watch glass (clock glass), followed by performing the agitation by the magnetic stirrer for 10 minutes to obtain the suspension. After performing the agitation, a total weight except for the watch glass was subjected to weighing and this weight was regarded as "C". Further, a tall beaker in which the magnetic stirrer was placed was prepared separately and subjected to weighing. This weight was regarded as "D".

The obtained suspension was filtered by using a membrane filter (cellulose acetate, 0.45 μm, ϕ47 mm), and the filtrate was introduced into the toll beaker which was subjected to the weighing. Then, the tall beaker in which the filtrate was contained was subjected to weighing. This weight was regarded as "E".

Then, the toll beaker in which the filtrate was contained was placed in the flow potential measurement apparatus and a third to a half of a contact window was immersed. The filtrate in the toll beaker was stirred by the magnetic stirrer for 5 minutes and an electrode piston was subjected to amplitude motion so that measurement sensitivity was appropriate. 0.1 ml of the aqueous solution of the cation reagent was dripped at intervals of 5 seconds and a titrated amount required to reach the inflection point was measured. The weight of the dripped cation reagent was regarded as "F".

The amount of the cationic group (cation equivalent) existing on the surfaces of the toner mother particles was calculated from the following expression.

(Cation equivalent (mol/g) existing on the surfaces of the toner mother particles)=(number of moles of sodium lauryl sulfate adsorbed to the toner mother particles)/(weight of introduced toner mother particles) $=\{(0.004\times5/1000)-0.0016\times(F/1000)\times(C-A-B)/(E-D)\}/B$ Further, the amount of the anionic group (anion equivalent) existing on the surfaces of the toner mother particles was measured in a similar manner as that of the cationic group (cation equivalent), except that the anion reagent and the cation reagent are exchanged with each other.

In particular, the flow potential measurement apparatus was similarly prepared, and the aqueous solution of the cation reagent having the concentration of 0.004 mol/l (benzethonium chloride, produced by Wako Pure Chemical Industries, Ltd.) was prepared as the titration reagent instead of the aqueous solution of the anion reagent having the same concentration. The aqueous solution of the anion reagent having the concentration of 0.0016 mol/l (sodium lauryl sulfate, produced by Wako Pure Chemical Industries, Ltd.) was prepared instead of the aqueous solution of the cation reagent having the same concentration.

The magnetic stirrer was placed in the beaker, and this weight was regarded as "A'". Then, the toner mother particles (1 g) were charged in the beaker, and the weight of toner mother particles was regarded as "B'".

Further, 5 ml of the aqueous solution of the cation reagent was charged into the beaker along a wall thereof by using a burette instead of the aqueous solution of the anion reagent and the toner mother particles were soaked in the cation reagent while an ultrasonic wave us applied for a minute. Then, 95 g of distilled water was added, followed by performing the agitation for 10 minutes to obtain a suspension. A total weight of the beaker in which the suspension was contained was subjected to weighing and this weight was regarded as "C'". Further, a tall beaker in which the magnetic stirrer was placed was prepared separately and subjected to weighing. This weight was regarded as "D'".

The obtained suspension was filtered by using a membrane filter (cellulose acetate, 0.45 μm, ϕ47 mm), and the filtrate was introduced into the toll beaker which was subjected to the weighing. Then, the tall beaker in which the filtrate was contained was subjected to weighing. This weight was regarded as "E".

Then, the toll beaker in which the filtrate was contained was placed in the flow potential measurement apparatus. The filtrate in the toll beaker was stirred by the magnetic stirrer and 0.1 ml of the aqueous solution of the anion reagent was dripped at intervals of 5 seconds. A titrated amount required to reach the inflection point was measured, and the weight of the dripped anion reagent was regarded as "F'".

The amount of the anionic group (anion equivalent) existing on the surfaces of the toner mother particles was calculated from the following expression.

(Anion equivalent (mol/g) existing on the surfaces of the toner mother particles) =(number of moles of benzethonium chloride adsorbed to the toner mother particles)/(weight of introduced toner mother particles) $=\{(0.004\times5/1000)-0.0016\times(F'/1000)\times(C'-A'-B')/(E'-D')\}/B'$ (2) Method for Measuring Cation Equivalent of Fine Particles of Electrification Control Resin The electrification control resin fine particle suspension was diluted with distilled water so that the concentration of the electrification control resin was 0.1% by mass, and 100 g of the electrification control resin fine particle suspension which was diluted with distilled water was sampled in the beaker.

The toll beaker in which the diluted liquid was contained was placed in the flow potential measurement apparatus (Automatic Potentiometric Titrator AT-510, produced by KYOTO ELECTRONICS PRODUCING CO., LTD. (setting conditions: wait time; 300 s, cut-off time: 5 s, unit volume: 0.1 ml, dispense speed: 10 s/ml, gain: 1, data sanp. pot: 4 mV, data sanp. Vol: 0.1 ml)) and a third to a half of a contact window was immersed. The diluted liquid in the toll beaker was stirred by the magnetic stirrer for 5 minutes and an electrode piston was subjected to amplitude motion so that measurement sensitivity was appropriate.

Thereafter, 0.1 ml of the anion reagent (0.004 mol/l, aqueous solution of sodium lauryl sulfate, produced by Wako Pure Chemical Industries, Ltd., density: 1.00 g/ml) was dripped at intervals of 5 seconds and a titrated amount required to reach the inflection point was measured.

The amount of the cationic group (cation equivalent) existing on the surfaces of the fine particles of the electrification control resin was calculated from the following expression.

(Cation equivalent(mol/g)existing on the surfaces of the fine particles of the electrification control resin)=(number of moles of sodium lauryl sulfate adsorbed to the fine particles of the electrification control resin)/(weight of the fine particles of the electrification control resin introduced)=(0.004× dripping amount of sodium lauryl sulfate/1000)/{100×(0.1/100)}

(3) Evaluation Method of Compatibility Between Binder Resin and Wax (Interface)

4 g of the binder resin was charged in a glass container, followed by being rotated for 4 hours at 5000 rpm by using a centrifugal separator (50A-IV, produced by Sakuma) in which the temperature was set at 100° C. After completing centrifugal separation, the glass container in which the binder resin was contained was temporarily taken out of the centrifugal separator and the fact that no air bubble was present in the binder resin was visually observed. After that, the binder resin was replaced in the centrifugal separator and was left to stand overnight to be gradually cooled so that the binder resin was not cracked.

4 g of the wax was charged in the glass container in which the binder resin was contained, and the glass container was placed in a oil bath at 100° C. to dissolve the wax (the first heating). After the wax was dissolved, the glass container was taken out of the oil bath, followed by being cooled at room temperature. After the wax was cooled, the image of the interface between the binder resin and the wax in the glass container was taken, and an actual Rz was calculated from the taken image as follows (Rz after the first heating):

actual *Rz*(compatibility between binder resin and wax/maximum height roughness due to corrosion,the same definition holds in the followings)=*Rz* in the taken image×(actual container height/container height in the taken image)

The glass container was again heated in the oil bath at 100° C. (second heating), and the heating was stopped 6 hours after, followed by being gradually cooled to the room temperature in a state that the glass container was placed in the oil bath. After the wax was cooled, the image of the interface between the binder resin and the wax in the glass container was taken, and an actual Rz was calculated in a similar manner to that of the first heating (Rz after the second heating).

Further, the average value of the actual Rz of the interface between the binder resin and the wax after the first heating and the actual Rz of the interface between the binder resin and the wax after the second heating was obtained.

With respect to the average Rz of the Rz after the first heating and the Rz after the second heating, compatibility was judged based on the following criteria (unit: mm).

Level 1: Interface was separated flatly $0 \leq Rz \leq 1.5$

Level 2: Slight roughness and/or corrosion by resin and wax was/were observed in interface $1.5 < Rz \leq 2.5$ Level 3: Roughness due to compatibility and/or corrosion was observed in interface $2.5 < Rz \leq 3.5$ Level 4: Roughness due to compatibility and/or corrosion was observed in interface some severely $3.5 < Rz \leq 4.5$ Level 5: Roughness due to compatibility and/or corrosion was observed in interface severely $4.5 < Rz$ (4) Evaluation Method of Compatibility Between Resin and Wax (DSC)

455 g of MEK, 45 g of the binder resin, and a stirrer bar were introduced into a container and the agitation was performed by a turbula mixer for 30 minutes to prepare a resin solution. The resin solution was stirred by the magnetic stirrer for 1 hour.

Subsequently, 34.65 g of the resin solution was introduced into a container in which 0.35 g of each of the waxes was contained and then the container was covered. The container was shaken appropriately to fuse each of the waxes while being placed in the hot water bath at 70° C., so that each of the waxes was dissolved in the resin solution. After observing fusion of each of the waxes, the container was taken out of the hot water bath and then gradually cooled overnight at the room temperature to obtain the suspension.

Further, the membrane filter (PTFE, 0.8 μm) was used to filter a supernatant of the suspension to obtain a filtrate.

Next, an aluminum pan for DSC/TG measurement was subjected to weighing and was heated at 85° C. 3 drops of the filtrate (about 0.0125 g) were dripped on the heated aluminum pan. After the sample obtained by dripping 3 drops of the filtrate was dried, a few drops of the filtrate were further dripped, so that the total number of drops of the filtrate was 8 drops. After 8 drops of the filtrate were dripped, the heating temperature was increased to 100° C., and was left for 3 hours, followed by being subjected to weighing of the sample and the aluminum pan.

The temperature of the sample was raised from −10° C. to 170° C. at 10° C./minutes (1st run) by using a differential scanning calorimetric analyzer (DSC6220, produced by SII NanoTechnology Inc.). Then, the temperature of the sample was cooled to −10° C. at 10° C./minutes, followed by being again raised to 170° C. at 10° C./minutes (2nd run). In accordance with a base line after an end temperature of glass transition of the binder resin in the 2nd run, the presence or absence of an endothermic area, which was appeared under the base line after binder resin-based change was observed. In a case that the endothermic area which was appeared under the base line after the binder resin-based change was not observed, the endothermic area was regarded as 0.

Noted that measurement of reference was similarly performed by introducing 9.7 mg of an aluminum plate into the same aluminum pan.

(5) Method for Measuring Endothermic Peak Area of Wax at Low Temperature Side

Measurement was performed by using the differential scanning calorimetric analyzer (DSC6220, produced by SII NanoTechnology Inc.).

About 5 mg of the sample (powder obtained by drying the object to be measured) was introduced into a special aluminum pan. The temperature of the sample was raised from −10° C. to 170° C. at 10° C./minutes (1st run). Then, the temperature of the sample was cooled to −10° C. at 10° C./minutes, followed by being again raised to 170° C. at 10° C./minutes (2nd run). An area (dimension) of an area which was formed under the base line when the base line in the 2nd run was extended was regarded as an endothermic peak area (endo peak area) at a low temperature side.

In a case that there was formed one divided area (in a case that there was one endothermic peak (endo peak)), the divided area was regarded as "the endothermic peak area at a low temperature side". In a case that there were formed 2 or more divided areas (in a case that there were 2 or more endothermic peaks), the area (dimension) of the divided area at the lowest temperature side was regarded as "the endothermic peak area at a low temperature side".

Noted that measurement of reference was similarly performed by introducing 9.7 mg of an aluminum plate into the same aluminum pan.

(6) Measurement of Glass Transition Temperature

Measurement was performed by using the differential scanning calorimetric analyzer (DSC6220, produced by SIT NanoTechnology Inc.).

About 5 mg of the sample (powder obtained by drying the object to be measured) was introduced into a special aluminum pan. The temperature of the sample was raised from −10° C. to 170° C. at 10° C./minutes (1st run). Then, the temperature of the sample was cooled to −10° C. at 10° C./minutes, followed by being again raised to 170° C. at 10° C./minutes (2nd run). The middle point of the glass transition temperature in the 2nd run was regarded as the glass transition temperature (Tg). Noted that measurement of reference was similarly performed by introducing 9.7 mg of an aluminum plate into the same aluminum pan.

(7) Method for Measuring Melt Density of Wax and Difference in Density

A test tube was subjected to weighing, and 6 g of the surfactant (product name: nanohana-sekken (rape blossom soap), 0.5% aqueous solution, density: 1 g/cm$^3$, produced by MIYOSHI SOAP CORPORATION) was introduced into the test tube. Then, a mark indicating 6 ml was put on the test tube at a position of a liquid surface.

Subsequently, an aluminum container was heated to 120° C. to dissolve the wax in the aluminum container. An empty test tube was immersed in the hot water bath of boiling water and the wax which was heated and dissolved was charged in the test tube up to the position of the mark indicating 6 ml.

Then, the test tube in which the wax was charged was gradually immersed in cool water at 24° C. from the bottom portion to solidify the wax from the bottom portion gradually. In this situation, the center of the liquid surface of the wax was collapsed in a state that the position of wall surface thereof was maintained.

The wax was subjected to weighing and melt density (density of when the wax was in the liquid state) was calculated from the measured weight and the volume (6 ml) in the liquid state.

Then, the surfactant as described above was charged in the recess (collapsed portion) on the surface of the wax until the volume reached 6 ml, and the volume of the wax in the solid state was found from the volume of the charged surfactant to calculate the density of the wax in the solid state.

(8) Method for Measuring Solid Content Concentration 2 to 20 g of the object to be measured was sampled in an aluminum container to measure the weight before being dried. Then, the sample was dried in the drying machine at 50° C. to measure weight of non-volatile content. The percentage of the weight of non-volatile content with respect to the weight before the drying was calculated as the solid content concentration (% by mass).

(9) Measurement of Average Particle Diameter of Fine Particles of Electrification Control Resin and Average Particle Diameter of Mother Fine Particles The volume average particle diameter of the fine particles of the electrification control resin in the electrification control resin fine particle suspension and the volume average particle diameter of the mother fine particles in the mother fine particle suspension were measured by using Microtrack particle size distribution measuring apparatus (UPA150, produced by Nikkiso Co., Ltd.).

Pure water was used as a dilution solvent. The refractive index of the solvent was set to 1.33. Further, the refractive index of the fine particles of the electrification control resin was set to 1.51 and the refractive index of the mother fine particles was set to 1.91.

The measurement was performed three times for the same sample, and the average value of the median diameters (50% diameter) was regarded as a representative value of the volume average particle diameter.

(10) Measurement of Average Particle Diameter of Toner Mother Particles

Particle size distribution measuring apparatus (Coulter Multisizer III produced by Beckman Coulter) was used. The measurement was performed by using the apparatus in which the aperture diameter was 100 μm.

0.2 g of the toner mother particles (powder obtained by drying the toner mother particle suspension) were dispersed (ultrasonic dispersion, if necessary) in 50 ml of distilled water by using a dispersing agent (PELEX OT-P, produced by Kao Corporation) to prepare a sample (slurry).

Subsequently, several drops (3 to 5 drops) of the sample were introduced into the measuring unit of the particle size distribution measuring apparatus by a filler or dripping pipette (2 ml) to measure particle diameters of about 50,000 particles, and the volume-based average particle diameter and the number-based average particle diameter were obtained.

6. Test of Fixing Performance of Toner

A fixing unit (HL-5340, produced by Brother Industries, Ltd.) was used off-line (fixing unit was removed from a printer body and was used) to evaluate the fixing performance of the toner in each of Examples and Comparative examples.

6 sheets of printed matter, each of which is not yet subjected to fixing and has a solid patch pattern for evaluating the fixing performance, were sampled to measure reflection density OD1 of the solid patch pattern. The reflection density was adjusted to 1.29 to 1.31. In a case that the reflection density was out of the range as described above, a development bias was changed to adjust the printing density.

Fixing was performed with respect to the 6 sheets of printed matter as described above while the temperature of the roller(s) of the fixing unit (velocity: 30 sheets/corresponding to min) was changed appropriately. Each of the solid patch patterns after the fixing was rubbed forward and backward five times with cloth while 300 g of load was applied. Then, reflection density OD2 of each of the solid patch patterns was measured again.

The rate of decrease in the reflection density (OD1−OD2/OD1) was calculated, and a temperature, in which the average value of the rates of decrease in the reflection density of 6 sheets of printed matter was less than 10%, was adopted as a lower limit of temperature to fix the toner (lower limit temperature to fix the toner).

Further, a printed matter, which is not yet subjected to fixing and has a printing pattern for evaluating offset, was printed, and the fixing was performed with respect to the printed matter, which was not yet subjected to fixing, by using the fixing unit as described above. In this situation, the evaluation was performed by changing the temperature to fix the toner to be higher than the lower limit temperature to fix the toner obtained in advance; presence or absence of the offset (offset on a high temperature side) which is a transfer of a part of the toner to the roller(s) of the fixing unit was visually observed; and the highest temperature at which the offset was not occurred was adopted as an upper limit of temperature to fix the toner (upper limit temperature to fix the toner).

TABLE 1

| Electrification control resin fine particle suspension | Manufacturing conditions: Materials: Electrification control resin | | Organic solvent | | Homogenizer (rpm) | Solidification Condition | | Physical properties: D50 (nm) | Solid content (%) | fine particles of electrification control resin: Cation equivalent (mol/g) |
|---|---|---|---|---|---|---|---|---|---|---|
| A | A | 17.5 parts by mass | MEK | 82.5 parts by mass | 16000 | 75° C. | 140 mins | 132 | 19.5 | $7.194 \times 10^{-05}$ |
| B | A | 35 parts by mass | MEK | 65 parts by mass | 16000 | 60° C. | 120 mins | 355 | 37.2 | $4.432 \times 10^{-05}$ |
| C | B | 17.5 parts by mass | MEK | 82.5 parts by mass | 16000 | 80° C. | 90 mins | 277 | 23.2 | $2.259 \times 10^{-05}$ |
| D | B | 35 parts by mass | MEK | 65 parts by mass | 10000 | 80° C. | 90 mins | 508 | 36.8 | $5.260 \times 10^{-06}$ |
| E | B | 35 parts by mass | MEK | 65 parts by mass | 8000 | 80° C. | 90 mins | 750 | 38.3 | $4.020 \times 10^{-06}$ |

TABLE 2

| Wax | Melt point (° C.) | Melt density (100° C.) (g/ml) | Difference in density (g/ml) | Compatibility between binder resin and wax Level of state of interface (average) |
|---|---|---|---|---|
| A | 61 | 0.809 | 0.121 | 2 |
| B | 63 | 0.811 | 0.145 | 2 |
| C | 72 | 0.815 | 0.133 | 1 |
| D | 68 | 0.832 | 0.132 | 2 |
| E | 71 | 0.884 | 0.089 | 3 |
| F | 82 | 0.871 | 0.109 | 4 |

TABLE 2-continued

| Wax | Melt point (° C.) | Melt density (100° C.) (g/ml) | Difference in density (g/ml) | Compatibility between binder resin and wax Level of state of interface (average) |
|---|---|---|---|---|
| G | 77 | 0.870 | 0.110 | 3 |
| H | 66 | 0.877 | 0.101 | 2 |
| I | 94 to 96 | 0.831 | 0.057 | 2 |
| J | 74 to 76 | 0.831 | 0.108 | 2 |

TABLE 3

| Wax | Compatibility (DSC): Endo peak 1 (° C.) | Endo peak area (mJ/mg) | Tig (° C.) | Tmg (° C.) | DSC analysis (2nd): Endo peak 1 (° C.) | Endo peak area (mJ/mg) | Endo peak 2 (° C.) | Endo peak area (mJ/mg) | Endo peak 3 (° C.) | Endo peak area (mJ/mg) | Peak average (° C.) | Total peak area (mJ/mg) |
|---|---|---|---|---|---|---|---|---|---|---|---|---|
| A | 57.2 | 1.66 | 35.1 | 41.9 | 63.6 | 225 | — | — | — | — | 63.6 | 225 |
| B | 59.0 | 0.88 | 40.5 | 47.1 | 66.7 | 213 | — | — | — | — | 66.7 | 213 |
| C | 59.0 | 0.08 | 36.5 | 44.4 | 73.1 | 199 | — | — | — | — | 73.1 | 199 |
| D | 58.2 | 0.82 | 44.0 | 48.9 | 67.1 | 200 | — | — | — | — | 67.1 | 200 |
| E | — | 0 | 38.7 | 46.0 | 71.2 | 139 | — | — | — | — | 71.2 | 139 |
| F | — | 0 | 41.2 | 47.9 | 63.6 | 28.3 | 84.3 | 134 | — | — | 80.7 | 162.3 |
| G | — | 0 | 38.8 | 46.5 | 65.2 | 35.6 | 77.8 | 149 | — | — | 75.4 | 184.6 |
| H | 63.6 | 0.20 | 41.0 | 53.1 | 54.3 | 13.4 | 67.4 | 120 | — | — | 66.1 | 133.4 |
| I | — | 0 | 40.8 | 46.8 | 33.6 | 16 | 84.5 | 10.1 | 97.3 | 116 | 89.2 | 142.1 |
| J | 69.7 | 0.04 | 38.3 | 43.1 | 75.2 | 139 | — | — | — | — | 75.2 | 139 |

TABLE 4

| Mother fine particle suspension | Manufacturing conditions: Materials (Oil phase): Binder resin | | Colorant dispersion | Wax | | Solidification: Condition (minutes) | Physical properties: D50 (nm) | Solid Content (%) |
|---|---|---|---|---|---|---|---|---|
| A | FC1565 | 149.4 parts by mass | A | A | 12.6 parts by mass | 150 | 342 | 27.3 |
| B | FC1565/FC1588 | 131.4/18 parts by mass | A | A | 12.6 parts by mass | 150 | 362 | 27.4 |
| C | FC1565 | 149.4 parts by mass | A | A/I | 12.6/2 parts by mass | 150 | 383 | 28.0 |

TABLE 4-continued

| Mother fine particle suspension | Manufacturing conditions: Materials (Oil phase): Binder resin | | Colorant dispersion | Wax | Solidification: Condition (minutes) | Physical properties: D50 (nm) | Solid Content (%) |
|---|---|---|---|---|---|---|---|
| D | ER508 | 149.4 parts by mass | B | A 12.6 parts by mass | 150 | 320 | 28.8 |
| E | ER508 | 149.4 parts by mass | B | A/I 12.6/2 parts by mass | 150 | 373 | 30.2 |
| F | FC1565 | 149.4 parts by mass | A | B 12.6 parts by mass | 140 | 354 | 26.2 |
| G | FC1565/FC1588 | 131.4/18 parts by mass | A | B 12.6 parts by mass | 140 | 379 | 26.5 |
| H | FC1565 | 149.4 parts by mass | A | C 12.6 parts by mass | 135 | 333 | 26.2 |
| I | FC1565/FC1588 | 131.4/18 parts by mass | A | C 12.6 parts by mass | 135 | 345 | 27.2 |
| J | FC1565 | 149.4 parts by mass | A | D 12.6 parts by mass | 150 | 333 | 25.6 |
| K | FC1565/FC1588 | 131.4/18 parts by mass | A | D 12.6 parts by mass | 150 | 352 | 25.3 |
| L | FC1565 | 149.4 parts by mass | A | E 12.6 parts by mass | 150 | 345 | 27.7 |
| M | FC1565 | 149.4 parts by mass | A | F 12.6 parts by mass | 150 | 325 | 25.1 |
| N | FC1565 | 149.4 parts by mass | A | G 12.6 parts by mass | 150 | 343 | 28.3 |
| O | FC1565 | 149.4 parts by mass | A | H 12.6 parts by mass | 140 | 362 | 27.8 |
| P | FC1565 | 149.4 parts by mass | A | I 12.6 parts by mass | 150 | 316 | 26.0 |
| Q | FC1565 | 149.4 parts by mass | A | J 12.6 parts by mass | 150 | 345 | 28.6 |

TABLE 5

| Toner Mother particle suspension | Manufacturing conditions: Materials: Mother fine particle suspension (parts by mass) | | Distilled water (Parts by mass) | Condition in which mother fine particles each have a spherical shape (minutes) | Physical properties: Volume average diameter (μm) | Number average diameter (μm) | Tg (° C.) | Toner mother particles: Anion equivalent (mol/g) | Cation equivalent (mol/g) | Difference of cation equivalent minus anion equivalent (mol/g) |
|---|---|---|---|---|---|---|---|---|---|---|
| A | A | 585.9 | 956.5 | 240 | 7.98 | 6.74 | 45.5 | $2.40 \times 10^{-05}$ | $2.43 \times 10^{-06}$ | $-2.16 \times 10^{-05}$ |
| B | B | 583.9 | 958.5 | 240 | 8.25 | 7.15 | 44.4 | $9.87 \times 10^{-06}$ | $2.24 \times 10^{-06}$ | $-7.63 \times 10^{-06}$ |
| C | C | 571.4 | 971.0 | 240 | 8.13 | 7.27 | 45.2 | $3.85 \times 10^{-06}$ | $1.52 \times 10^{-06}$ | $-2.33 \times 10^{-06}$ |
| D | D | 555.6 | 986.8 | 240 | 8.25 | 7.14 | 53 | $5.92 \times 10^{-07}$ | $1.32 \times 10^{-06}$ | $7.28 \times 10^{-07}$ |
| E | E | 529.8 | 1012.6 | 240 | 8.71 | 7.58 | 52.5 | $8.90 \times 10^{-08}$ | $1.32 \times 10^{-06}$ | $1.23 \times 10^{-06}$ |
| F | F | 611.0 | 931.4 | 280 | 8.05 | 6.88 | 46.1 | $2.02 \times 10^{-05}$ | $2.24 \times 10^{-06}$ | $-1.80 \times 10^{-05}$ |
| G | G | 603.8 | 938.6 | 280 | 8.38 | 7.43 | 45.3 | $8.31 \times 10^{-06}$ | $1.26 \times 10^{-06}$ | $-7.05 \times 10^{-06}$ |
| H | H | 611.6 | 930.8 | 270 | 7.91 | 6.69 | 45.9 | $1.75 \times 10^{-05}$ | $2.27 \times 10^{-06}$ | $-1.52 \times 10^{-05}$ |
| I | I | 588.2 | 954.2 | 270 | 8.25 | 7.49 | 45 | $9.20 \times 10^{-06}$ | $1.08 \times 10^{-06}$ | $-8.12 \times 10^{-06}$ |
| J | J | 626.1 | 916.3 | 240 | 7.71 | 6.60 | 47.7 | $1.08 \times 10^{-05}$ | $1.61 \times 10^{-06}$ | $-9.19 \times 10^{-06}$ |
| K | K | 632.4 | 910.0 | 240 | 7.97 | 6.93 | 46.9 | $4.89 \times 10^{-06}$ | $6.85 \times 10^{-07}$ | $-4.20 \times 10^{-06}$ |
| L | L | 577.7 | 964.7 | 300 | 7.81 | 6.58 | 50.4 | $8.75 \times 10^{-06}$ | $1.73 \times 10^{-06}$ | $-7.02 \times 10^{-06}$ |
| M | M | 523.4 | 1019.0 | 300 | 7.83 | 6.42 | 48.5 | $6.88 \times 10^{-07}$ | $4.41 \times 10^{-07}$ | $-2.47 \times 10^{-07}$ |
| N | N | 564.8 | 977.6 | 270 | 7.70 | 6.52 | 52.1 | $3.25 \times 10^{-06}$ | $1.02 \times 10^{-06}$ | $-2.23 \times 10^{-06}$ |
| O | O | 575.5 | 966.9 | 270 | 7.96 | 6.75 | 48.7 | $5.23 \times 10^{-06}$ | $1.39 \times 10^{-06}$ | $-3.84 \times 10^{-06}$ |
| P | P | 613.2 | 929.2 | 270 | 7.81 | 6.53 | 44.4 | $1.87 \times 10^{-07}$ | $6.59 \times 10^{-07}$ | $4.72 \times 10^{-07}$ |
| Q | Q | 553.3 | 989.1 | 240 | 7.80 | 6.54 | 44.3 | $9.84 \times 10^{-08}$ | $1.83 \times 10^{-07}$ | $8.46 \times 10^{-08}$ |

TABLE 6

| Examples Comparative Examples | Preparation of toner (mixing process) Materials: Mother particle suspension | Electrification control resin fine particle Suspension | Processing condition (° C.) | After mixing process Yield (wt %) | | Effect: Lower limit temperature to fix toner (° C.) | Upper limit temperature to fix toner (° C.) |
|---|---|---|---|---|---|---|---|
| Example 1 | A | A 41 parts by mass | 46 | 80.3 | + | 175.0 | 210 |
| Example 2 | B | A 41 parts by mass | 44 | 88.0 | ++ | 170.0 | 200 |
| Example 3 | C | A 41 parts by mass | 45 | 92.6 | ++ | 168.3 | 200 |
| Example 4 | C | B 22 parts by mass | 45 | 98.6 | +++ | 170.4 | 210 |
| Example 5 | C | C 35 parts by mass | 45 | 99.8 | +++ | 169.5 | 200 |
| Example 6 | C | D 22 parts by mass | 45 | 98.2 | +++ | 169.5 | 210 |
| Example 7 | A | D 22 parts by mass | 46 | 90.6 | ++ | 175.0 | 210 |
| Example 8 | D | D 22 parts by mass | 53 | 99.8 | +++ | 171.3 | 230 |
| Example 9 | F | A 41 parts by mass | 46 | 82.1 | + | 167.3 | 210 |
| Example 10 | G | A 41 parts by mass | 46 | 89.8 | ++ | 163.2 | 200 |
| Example 11 | G | C 35 parts by mass | 46 | 98.5 | +++ | 162.6 | 200 |
| Example 12 | H | A 41 parts by mass | 46 | 84.4 | + | 167.5 | 220 |
| Example 13 | I | D 22 parts by mass | 46 | 96.2 | +++ | 163.8 | 210 |
| Example 14 | J | A 41 parts by mass | 46 | 86.2 | + | 177.9 | 200 |
| Example 15 | K | D 22 parts by mass | 46 | 97.8 | +++ | 171.5 | 190 |
| Comparative Example 1 | L | A 41 parts by mass | 51 | 85.3 | + | 185.6 | 210 |
| Comparative Example 2 | M | A 41 parts by mass | 49 | 99.4 | +++ | 185.5 | 210 |
| Comparative Example 3 | N | A 41 parts by mass | 52 | 93.8 | ++ | 185.8 | 200 |
| Comparative Example 4 | O | A 41 parts by mass | 49 | 88.9 | ++ | 186.1 | 220 |
| Comparative Example 5 | P | A 41 parts by mass | 44 | 99.7 | +++ | 188.3 | 220 |
| Comparative Example 6 | Q | A 41 parts by mass | 44 | 98.8 | +++ | 180.0 | 210 |
| Reference Example 1 | C | E 21 parts by mass | 45 | 99.2 | +++ | — | — |
| Reference Example 2 | E | A 41 parts by mass | 53 | 99.5 | +++ | — | — |

What is claimed is:

1. A toner, comprising toner mother particles which contain a binder resin, a colorant, and a wax, wherein the wax is selected from the group consisting of stearic acid stearyl, stearic acid behenyl, heneicosanoic acid behenyl, dipentaerythritol hexamyristate, myristic acid behenyl, and combinations thereof;

wherein a difference between a density of the wax in a solid state at 24° C. and a density of the wax in a liquid state at 120° C. is not less than 0.11 g/cm$^3$;

the density of the wax in the liquid state at 120° C. is not more than 0.835 g/cm$^3$; and a heat quantity of the wax per unit mass which is obtained from an endothermic peak area at a low temperature side measured by a differential scanning calorimetry is not less than 190 mJ/mg, and an anion equivalent of the toner mother particles is not more than $1\times10^{-5}$ mol/g and is more than 0 mol/g.

2. The toner according to claim 1, wherein the binder resin is a polyester resin; and the wax is an ester-based wax.

3. The toner according to claim 1, wherein the wax includes the stearic acid behenyl.

4. The toner according to claim 1, wherein the wax includes the heneicosanoic acid behenyl.

5. The toner according to claim 1, wherein a difference calculated by subtracting anion equivalent from cation equivalent of the toner mother particles is $-1.1\times10^{-5}$ to $1\times10^{-6}$ mol/g.

6. The toner according to claim 1, wherein the difference between the density of the wax in the solid state at 24° C. and the density of the wax in the liquid state at 120° C. is not less than 0.133 g/cm$^3$ and not more than 0.145 g/cm$^3$.

7. A method for producing a toner, comprising:

preparing an electrification control resin particle suspension in which electrification control resin particles are dispersed, by removing a first organic solvent from a first emulsion obtained such that an electrification control resin, the first organic solvent, and a first water base medium are blended to be emulsified;

preparing a mother particle suspension in which mother particles containing a binder resin, a colorant, and a wax are dispersed, by removing a second organic solvent from a second emulsion obtained such that the binder resin, the colorant, the wax, the second organic solvent, and a second water base medium are blended to be emulsified, wherein the wax is selected from the group consisting of stearic acid stearyl, stearic acid behenyl, heneicosanoic acid behenyl, dipentaerythritol hexamyristate, myristic acid behenyl, and combinations thereof;

preparing a toner mother particle suspension in which toner mother particles are dispersed, by heating the mother particle suspension to fuse and aggregate the mother particles to form the toner mother particles; and mixing the electrification control resin particle suspension and the toner mother particle suspension, wherein a difference between a density of the wax in a solid state at 24° C. and a density of the wax in a liquid state at 120° C. is not less than 0.11 g/cm$^3$;

the density of the wax in the liquid state at 120° C. is not more than 0.835 g/cm$^3$;

a heat quantity of the wax per unit mass which is obtained from an endothermic peak area at a low temperature side measured by a differential scanning calorimetry is not less than 190 mJ/mg; and an anion equivalent of the toner mother particles is not more than $1\times10^{-5}$ mol/g and is more than 0 mol/g.

8. The method for producing the toner according to claim 7, wherein a cation equivalent of the electrification control resin particles is $5.0\times10^{-6}$ to $5.0\times10^{-5}$ mol/g.

9. The method for producing the toner according to claim 7, wherein the binder resin is a polyester resin; and the wax is an ester-based wax.

10. The method for producing the toner according to claim 7, wherein the wax includes stearic acid behenyl.

11. The method for producing the toner according to claim 7, wherein the wax includes heneicosanoic acid behenyl.

12. A method for producing a toner, comprising:

preparing an electrification control resin particle suspension in which electrification control resin particles are dispersed, by removing a first organic solvent from a first emulsion obtained such that an electrification control resin, the first organic solvent, and a first water base medium are blended to be emulsified;

preparing a mother particle suspension in which mother particles containing a binder resin, a colorant, and a wax are dispersed, by removing a second organic solvent from a second emulsion obtained such that the binder resin, the colorant, the wax, the second organic solvent, and a second water base medium are blended to be emulsified, wherein the wax is selected from the group consisting of stearic acid stearyl, stearic acid behenyl, heneicosanoic acid behenyl, dipentaerythritol hexamyristate, myristic acid behenyl, and combinations thereof;

preparing a toner mother particle suspension in which toner mother particles are dispersed, by heating the mother particle suspension to fuse and aggregate the mother particles to form the toner mother particles; and mixing the electrification control resin particle suspension and the toner mother particle suspension, wherein a difference between a density of the wax in a solid state at 24° C. and a density of the wax in a liquid state at 120° C. is not less than 0.11 g/cm$^3$;

the density of the wax in the liquid state at 120° C. is not more than 0.835 g/cm$^3$;

a heat quantity of the wax per unit mass which is obtained from an endothermic peak area at a low temperature side measured by a differential scanning calorimetry is not less than 190 mJ/mg; an anion equivalent of the toner mother particles is not more than $1\times10^{-5}$ mol/g and is more than 0 mol/g; and a difference calculated by subtracting anion equivalent from cation equivalent of the toner mother particles is $-1.1\times10^{-5}$ to $1\times10^{-6}$ mol/g.

13. The method for producing the toner according to claim 12, wherein a cation equivalent of the electrification control resin particles is $5.0\times10^{-6}$ to $5.0\times10^{-5}$ mol/g.

14. The method for producing the toner according to claim 12, wherein the binder resin is a polyester resin; and the wax is an ester-based wax.

15. The method for producing the toner according to claim 12, wherein the wax includes stearic acid behenyl.

16. The method for producing the toner according to claim 12, wherein the wax includes heneicosanoic acid behenyl.

* * * * *